US008870342B2

(12) United States Patent
Inoue

(10) Patent No.: US 8,870,342 B2
(45) Date of Patent: Oct. 28, 2014

(54) INKJET RECORDING APPARATUS

(75) Inventor: Hiroshi Inoue, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 13/618,395

(22) Filed: Sep. 14, 2012

(65) Prior Publication Data

US 2013/0076830 A1 Mar. 28, 2013

(30) Foreign Application Priority Data

Sep. 28, 2011 (JP) ..... 2011-212937

(51) Int. Cl.
*B41J 2/165* (2006.01)

(52) U.S. Cl.
CPC ..... *B41J 2/16535* (2013.01); *B41J 2/16552* (2013.01)
USPC ..... 347/33

(58) Field of Classification Search
CPC . B41J 2/16547; B41J 2/16544; B41J 2/16535
USPC ..... 347/33
See application file for complete search history.

(56) References Cited

U.S. PATENT DOCUMENTS 5,103,244 A * 4/1992 Gast et al. ..... 347/33
5,239,316 A * 8/1993 Demarchi et al. ..... 347/33
6,550,891 B1 * 4/2003 Berg ..... 347/33
2003/0081056 A1 * 5/2003 Nakagawa et al. ..... 347/33
2007/0081023 A1 4/2007 Morgan et al.
2010/0214356 A1 * 8/2010 Maida et al. ..... 347/28
2010/0231674 A1 * 9/2010 Domoto et al. ..... 347/103
2010/0238234 A1 9/2010 Inoue
2010/0245466 A1 9/2010 Inoue
2011/0050801 A1 * 3/2011 Uemura ..... 347/33

FOREIGN PATENT DOCUMENTS

JP 2002-331674 A 11/2002
JP 2010-234667 A 10/2010
JP 2010-241127 A 10/2010
WO 2004/106041 A2 12/2004

* cited by examiner

*Primary Examiner* — Stephen Meier
*Assistant Examiner* — Alexander D Shenderov
(74) *Attorney, Agent, or Firm* — Birch, Stewart, Kolasch & Birch, LLP

(57) ABSTRACT

According to an inkjet recording apparatus as an aspect of the present invention, the nozzle surface is wiped by a wiping member which rotates about an axle perpendicular to the nozzle surface. Consequently, the nozzle surface can be wiped in multiple directions and it is possible effectively to prevent deterioration of the lyophobic film, or adhering material being pushed inside the nozzles, due to wiping in one direction only. Furthermore, since a composition which rotates only the wiping member is adopted, then the composition of the wiping apparatus can be made compact.

14 Claims, 20 Drawing Sheets

INKJET RECORDING APPARATUS

BACKGROUND OF THE INVENTION

1. Field of the Invention

The present invention relates to an inkjet recording apparatus and more particularly, to technology for cleaning a nozzle surface of an inkjet head.

2. Description of the Related Art

If a recording operation is carried out continuously in an inkjet recording apparatus, then ink adheres and accumulates in the vicinity of the nozzles and can have adverse effects on ejection accuracy. Consequently, in an inkjet recording apparatus, cleaning of the nozzle surface of the head is carried out periodically.

Japanese Patent Application Publication No. 2010-241127 describes a method of wiping and cleaning a nozzle surface of a head provided in an inclined fashion, with a wiping web, in which a nozzle surface is wiped by abutting and pressing a wiping web travelling in one direction against the nozzle surface by a pressing roller provided in parallel to the nozzle surface.

Furthermore, Japanese Patent Application Publication No. 2010-234667 describes a method of preventing wiping residue by using a wiping web of which the liquid absorption capability is switched by changing the orientation of the web, and a nozzle surface is wiped two times while switching the direction of travel of the wiping web.

However, in the method described in Japanese Patent Application Publication No. 2010-241127, since the wiping direction is uniform at all times, then there is a problem in that deterioration of the lyophobic film (detachment of the lyophobic film, and the like), and infiltration of adhering material inside the nozzles, progresses in the wiping direction.

On the other hand, in the method described in Japanese Patent Application Publication No. 2010-234667, switching of the wiping direction is carried out, but since the wiping is switched between two directions, then this does not resolve the problem described above, and there are still problems such as deterioration of the lyophobic film in the wiping direction and progressive infiltration of adhering material inside the nozzle. Furthermore, in the method in Japanese Patent Application Publication No. 2010-234667, since the wiping direction is switched by changing the orientation of the whole apparatus, then there is a problem in that the apparatus becomes large in size.

SUMMARY OF THE INVENTION

The present invention was devised in view of these circumstances, an object thereof being to provide an inkjet recording apparatus having a high nozzle surface cleaning capability.

The means for solving the aforementioned problems are described below.

A first mode of the present invention provides an inkjet recording apparatus, comprising: a conveyance device which conveys a recording medium; an inkjet head which has a nozzle surface, in which nozzles are arranged, and which ejects ink droplets from the nozzles towards the recording medium which is conveyed by the conveyance device; and a wiping apparatus which wipes the nozzle surface by moving relatively along the nozzle surface of the inkjet head, wherein the wiping apparatus comprises: a wiping member which is abutted against the nozzle surface; and a rotational drive device which causes the wiping member to rotate about an axis perpendicular to the nozzle surface.

According to the first mode, the nozzle surface is wiped by a wiping member which rotates about an axle perpendicular to the nozzle surface. Consequently, the nozzle surface can be wiped in multiple directions and it is possible effectively to prevent deterioration of the lyophobic film, or adhering material being pushed inside the nozzles, due to wiping in one direction only. Furthermore, since a composition which rotates only the wiping member is adopted, then the composition of the wiping apparatus can be made compact.

According to a second mode, the inkjet recording apparatus according to the first mode described above further comprises: a supporting device which supports the wiping member movably in a direction perpendicular to the nozzle surface; and an biasing device which biases the wiping member towards the nozzle surface.

According to the second mode, it is possible to abut and press the wiping member against the nozzle surface (adopting a so-called suspension structure). Consequently, the nozzle surface can be wiped in a stable fashion without applying excessive load to the nozzle surface.

According to a third mode, in the inkjet recording apparatus according to the second mode, the supporting device supports the wiping member movably in a direction perpendicular to the nozzle surface, as well as supporting the wiping member in oscillatable fashion.

According to the third mode, the wiping member is provided so as to be advanceable and retractable with respect to the nozzle surface, as well as being capable of oscillating. Consequently, it is possible to abut the wiping member against the nozzle surface in a more stable state.

According to a fourth mode, the inkjet recording apparatus according to the first mode described above further comprises: a rod which is coupled to the wiping member; a rotating base which is driven so as to rotate by the rotational drive device; a guide hole for guiding the rod, the guide hole being formed in the rotating base, and through which the rod is inserted; and a spring, one end of which is coupled to the wiping member and the other end of which is coupled to the rotating base.

According to the fourth mode, it is possible to abut and press the wiping member against the nozzle surface (adopting a so-called suspension structure). Consequently, the nozzle surface can be wiped in a stable fashion without applying excessive load to the nozzle surface.

According to a fifth mode, in the inkjet recording apparatus according to the fourth mode described above, the guide hole is formed in a tapered shape so as to broaden towards the wiping member side.

According to the fifth mode, the wiping member is provided so as to be advanceable and retractable with respect to the nozzle surface, as well as being capable of oscillating, by the action of the guide hole formed in a tapered shape. Consequently, it is possible to abut the wiping member against the nozzle surface in a more stable state.

According to a sixth mode, in the inkjet recording apparatus according to the fourth or fifth mode, a plurality of rods each of which serves as the rod and a plurality of guide holes each of which serves as the guide hole are arranged concentrically with the center of rotation of the wiping member.

According to the sixth mode, a plurality of rods and a plurality of guide holes are arranged concentrically with the center of rotation of the wiping member. Consequently, it is possible to make the wiping member abut against the nozzle surface in a stable state, and the wiping member can be rotated in a stable state.

According to a seventh mode, in the inkjet recording apparatus according to any one of the first to sixth modes described above, the wiping member is formed in a circular disk shape and is formed in a tapered shape so that a circumferential edge portion diverges.

According to the seventh mode, the wiping member is formed in a circular disk shape and is formed in a tapered shape in such a manner that the circumferential edge section diverges. Consequently, when the wiping apparatus and the inkjet head are moved relatively and the wiping member is abutted against the nozzle surface, the action of abutting the wiping member against the nozzle surface can be performed easily. More specifically, when the wiping apparatus and the inkjet head are moved relatively in a state where the end face (wiping surface) of the wiping member is positioned slightly higher than the position of the nozzle surface, the end portion of the nozzle surface abuts against the circumferential edge section of the wiping member which is formed in a tapered shape, and pushes down the wiping member along the inclination of the circumferential edge section. Consequently, the wiping member can be abutted against the nozzle surface easily.

According to an eighth mode, in the inkjet recording apparatus according to the seventh mode described above, a recess section is formed in the center of the wiping member.

According to the eighth mode, a recess section is formed in the center of the wiping member (the center of rotation). Consequently, it is possible to prevent a particular position on the wiping member from being abutted continuously against the nozzle surface.

According to a ninth mode, in the inkjet recording apparatus as defined in any one of the first to eighth modes described above, the wiping member comprises: a pad; and a replaceable wiping cloth which covers a front surface of the pad.

According to the ninth mode, by replacing the wiping cloth, it is possible to restore the cleaning properties easily.

According to a tenth mode, in the inkjet recording apparatus of the ninth mode, the pad is provided detachably.

According to the tenth mode, the pad is provided detachably. Consequently, replacement of the wiping cloth can be carried out easily.

According to an eleventh mode, in the inkjet recording apparatus as defined in the tenth mode described above, the pad comprises: a pad main body; and a ring-shaped cover member, which is provided detachably on the pad main body and which covers a circumferential edge portion of the pad main body, the wiping cloth being installed on the pad main body by sandwiching a circumferential edge portion of the wiping cloth between the pad main body and the cover member.

According to the eleventh mode, the wiping cloth is installed on the pad by sandwiching the wiping cloth between the pad main body and the cover member. Consequently, replacement of the wiping cloth can be carried out easily.

According to a twelfth mode, in the inkjet recording apparatus according to any one of the ninth to eleventh modes, at least the portion of the pad that is covered by the wiping cloth is made from an elastic body.

According to the twelfth mode, the pad is constituted by an elastic body. Consequently, the wiping cloth can be abutted without applying excessive load to the nozzle surface.

According to a thirteenth mode, the inkjet recording apparatus as defined in any one of the first to twelfth modes described above further comprises a cleaning liquid deposition device which deposits cleaning liquid onto the nozzle surface by moving relatively along the nozzle surface of the inkjet head.

According to the present mode, a cleaning liquid deposition device which deposits cleaning liquid onto the nozzle surface is provided. Consequently, it is possible to wipe the nozzle surface in a moistened state, the cleaning properties can be improved, and damage to the nozzle surface can be reduced.

According to a fourteenth mode, in the inkjet recording apparatus as defined in the thirteenth mode, herein the wiping apparatus has a tray which is provided below the wiping member, and which recovers the cleaning liquid that has dripped down from the wiping member.

According to the fourteenth mode, a tray which recovers cleaning liquid that has dripped down from the wiping member is provided below the wiping member. Consequently, even if the nozzle surface is wiped by depositing cleaning liquid, it is possible to prevent scattering of the cleaning liquid to the peripheral area.

According to a fifteenth mode, in the inkjet recording apparatus as defined in any one of the first to fourteenth modes, the conveyance device conveys the recording medium by wrapping the recording medium about a circumferential surface of a rotating drum; and the inkjet head is arranged in an inclined fashion with respect to the horizontal plane, in such a manner that the nozzle surface opposes the circumferential surface of the drum.

According to the fifteenth mode, it is possible to wipe the nozzle surface efficiently with a compact composition, in an inkjet head in which the nozzle surface is provided in an inclined fashion.

According to the present invention, soiling, and the like, which is adhering to the nozzle surface can be wiped reliably. Furthermore, it is also possible to prevent deterioration of the lyophobic film or adhering material being pushed inside the nozzles.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DESCRIPTION OF THE PREFERRED EMBODIMENTS

First Embodiment

<Example of Composition of Inkjet Recording Apparatus>

Figure 1:
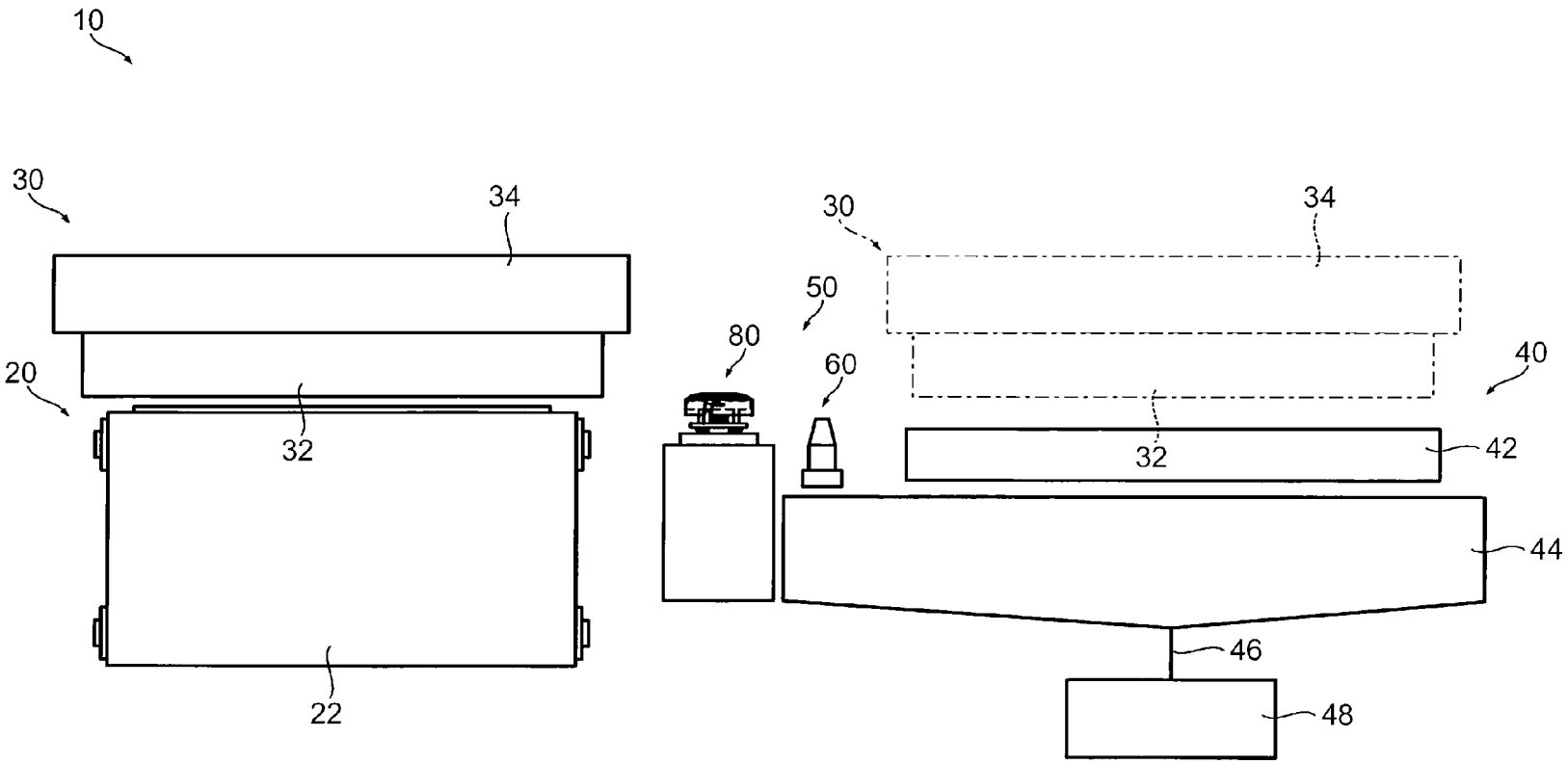
FIG. 1 is a front view diagram showing the composition of the principal part of an inkjet recording apparatus (first embodiment)
Figure 2:
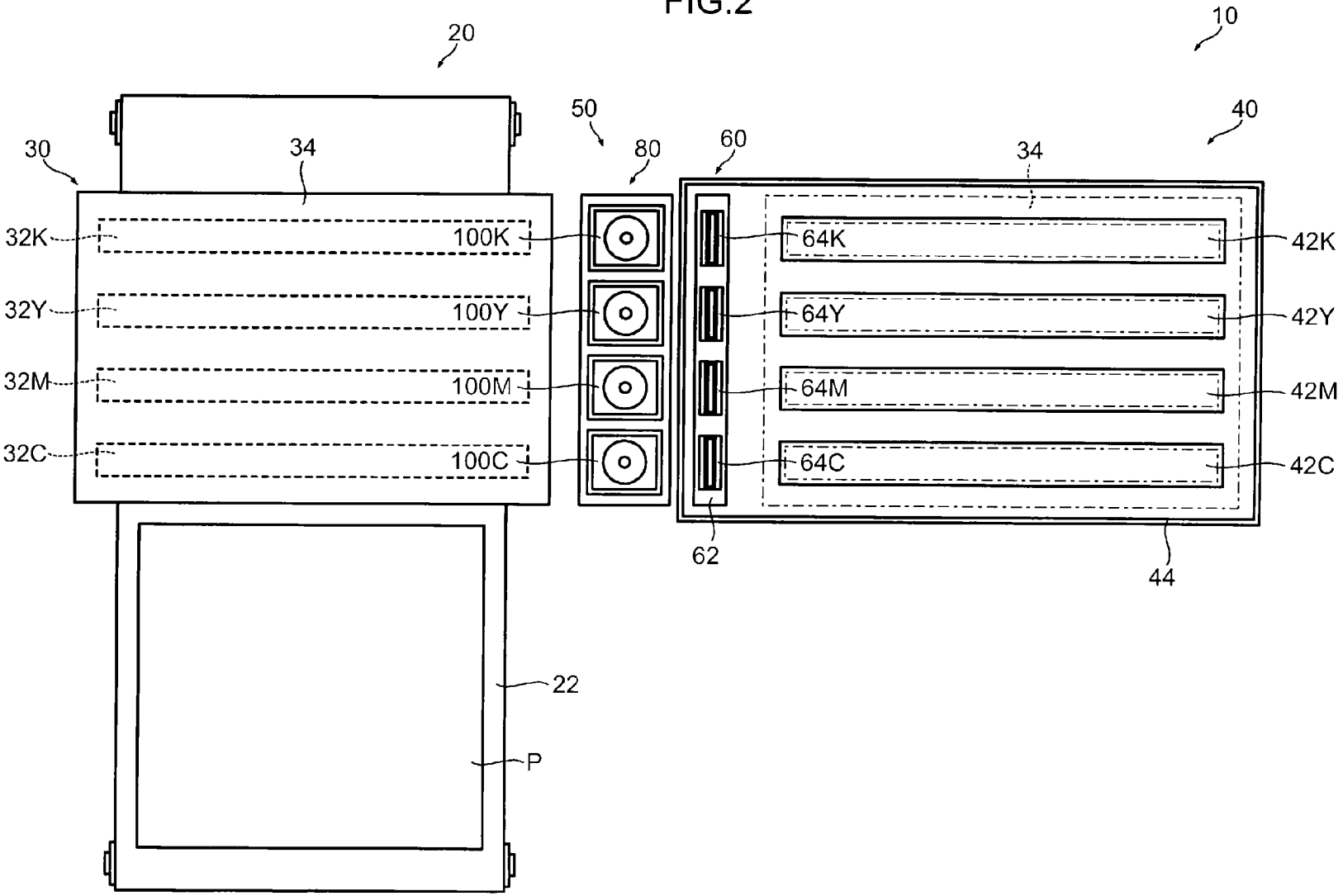
FIG. 2 is a plan diagram showing the composition of the principal part of an inkjet recording apparatus (first embodiment)
Figure 3:
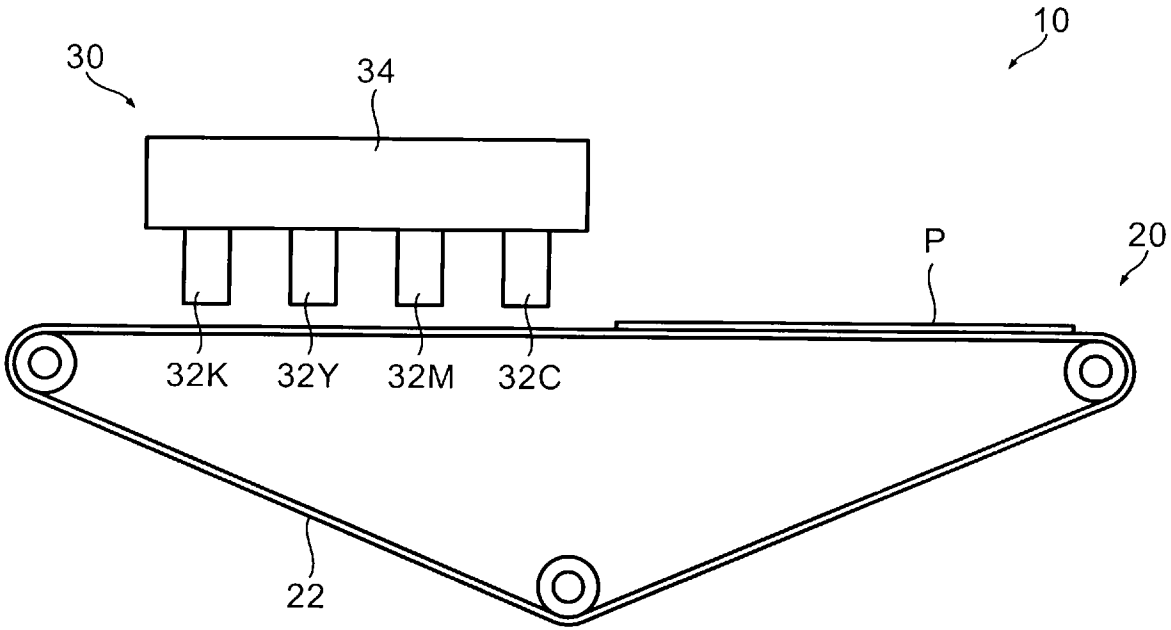
FIG. 3 is a side view diagram showing the composition of the principal part of an inkjet recording apparatus (first embodiment)

FIG. 1 to FIG. 3 are respectively a front view diagram, a plan diagram and a side view diagram showing a composition of the principal part of an inkjet recording apparatus relating to the present embodiment.

As shown in FIGS. 1 to 3, this inkjet recording apparatus 10 is a single-pass type of line printer, which is principally constituted by a paper conveyance mechanism 20 for conveying paper (cut sheet paper) P which is a recording medium, a head unit 30 which ejects ink droplets of respective colors of cyan (C), magenta (M), yellow (Y) and black (K) toward paper P which is conveyed by the paper conveyance mechanism 20, a maintenance unit 40 which carries out maintenance of the respective heads installed on the head unit 30, and a nozzle surface cleaning unit 50 which cleans the nozzle surfaces of the respective heads installed on the head unit 30.

The paper conveyance mechanism 20 is constituted by a belt conveyance mechanism and conveys the paper P horizontally by suctioning the paper P on a travelling belt 22.

The head unit 30 is principally constituted by a head 32C which ejects cyan ink droplets, a head 32M which ejects magenta ink droplets, a head 32Y which ejects yellow ink droplets, a head 32K which ejects black ink droplets, a head supporting frame 34 on which the heads 32C, 32M, 32Y, 32K are installed, and a head supporting frame movement mechanism (not illustrated) which moves the head supporting frame 34.

The heads (inkjet heads) 32C, 32M, 32Y, 32K are constituted by line heads which correspond to the maximum width of the paper P which is the object of printing. The heads 32C, 32M, 32Y, 32K each have the same composition, and are therefore referred to as the head 32 or heads 32 below, unless a specific head is to be distinguished.

The heads 32 (32C, 32M, 32Y, 32K) are formed in a rectangular block shape, and nozzle surfaces 33 (33C, 33M, 33Y, 33K) in which nozzles N are arranged are formed in the lower face portion of each head.

Figure 4:
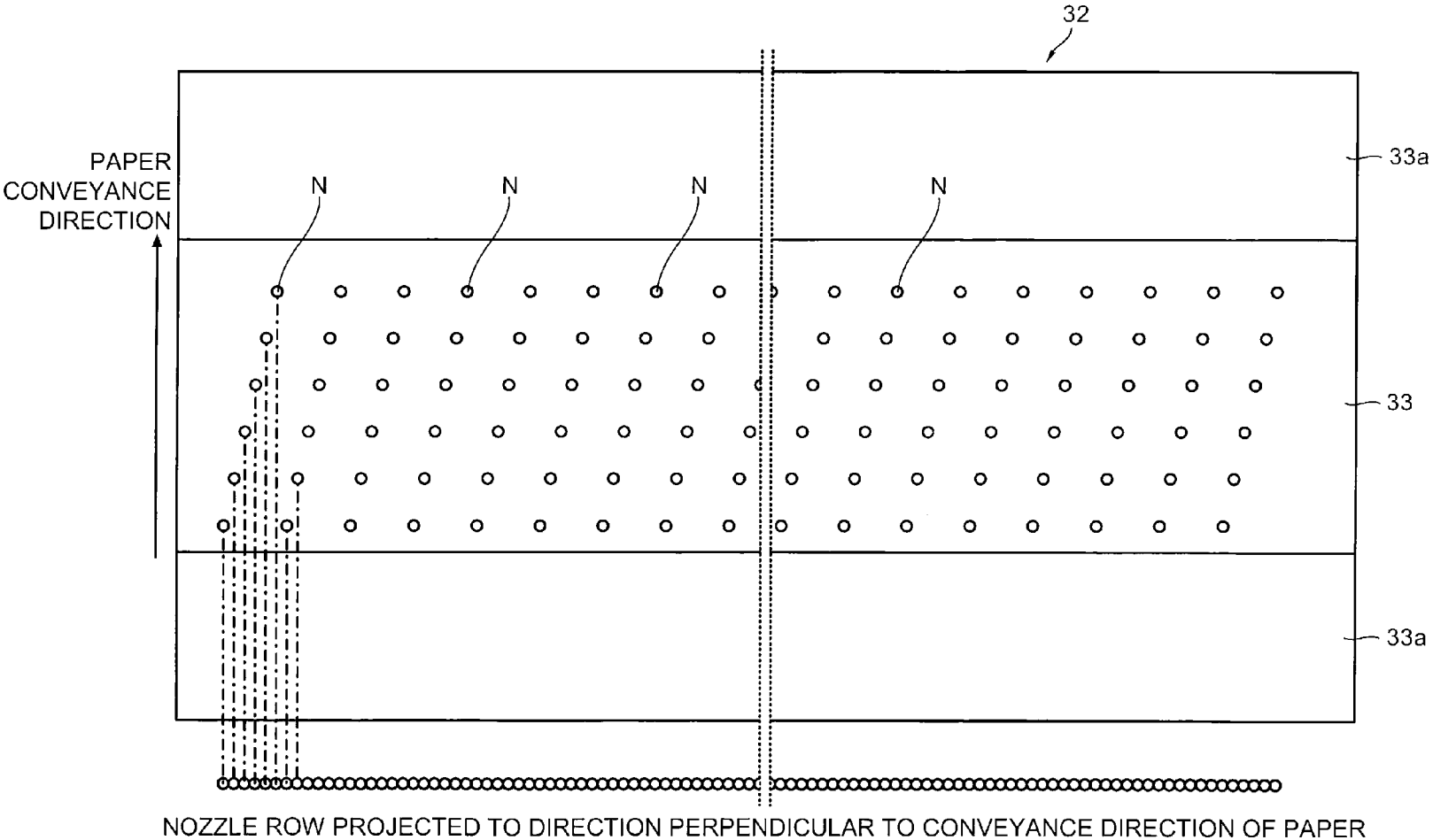
FIG. 4 is a lower surface diagram of a head.

FIG. 4 is a lower surface diagram of a head. Furthermore, FIG. 5 is a lower end side face diagram of a head.

Figure 5:
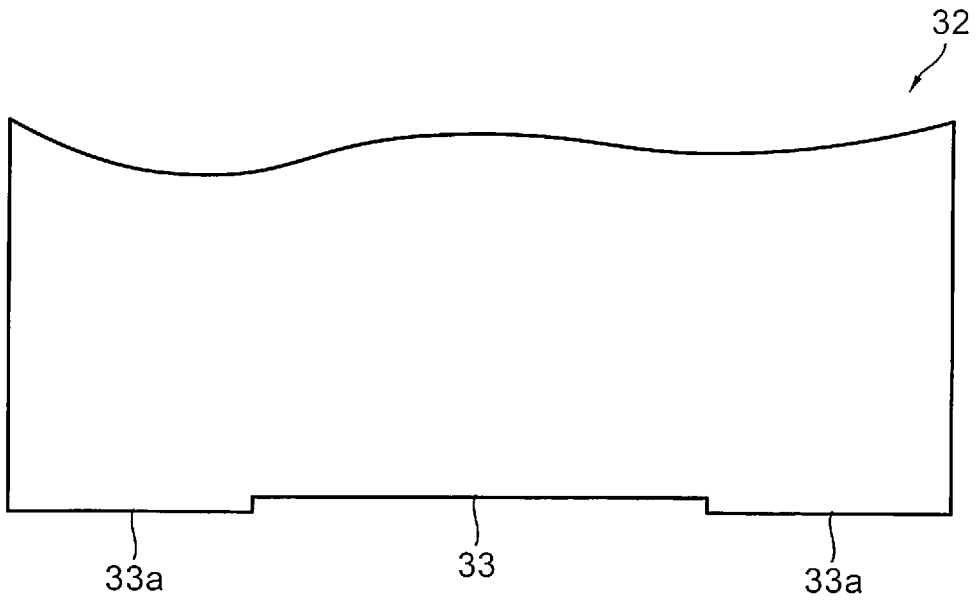
FIG. 5 is a side view diagram of a lower end of a head.

As shown in FIG. 5, the nozzle surface 33 is formed in a band-shape (rectangular shape) in the center of the lower surface of the head 32. A band-shaped (rectangular shaped) nozzle surface protecting section 33*a* is provided on both sides of the nozzle surface 33 (either side of the nozzle surface 33 in a direction perpendicular to the lengthwise direction), so as to sandwich the nozzle surface 33. As shown in FIG. 5, the nozzle surface protecting sections 33*a* are provided in order to protect the nozzle surface 33, and are formed to project beyond the nozzle surface 33. A lyophobic treatment is applied to the nozzle surfaces 33 (for example, a lyophobic film is formed on the surface thereof).

The nozzles N are arranged in a two-dimensional matrix configuration on the nozzle surface 33. In other words, nozzles are arranged at a uniform pitch in a direction which is inclined at a prescribed angle with respect to the lengthwise direction of the nozzle surface 33, as well as being arranged at a uniform pitch in the lengthwise direction of the nozzle surface 33. By arranging the nozzles N in this way, it is possible to reduce the effective pitch between nozzles N when projected in the lengthwise direction of the head 32, and a high-density arrangement of the nozzles N can be achieved.

The head supporting frame 34 includes a head installation section (not illustrated) for installing the heads 32. The heads 32 are installed detachably in this head installation section.

The heads 32 installed on the head supporting frame 34 are arranged perpendicularly with respect to the conveyance direction of the paper P (in such a manner that the nozzle rows of each head 32 are perpendicular to the conveyance direction of the paper P). Furthermore, the heads 32 are also arranged at a uniform interval apart in a prescribed order in the conveyance direction of the paper P (in the present example, the heads 32 are arranged in the order: cyan, magenta, yellow and black). Moreover, the nozzle surfaces 33 are arranged horizontally (in parallel with the paper P).

Furthermore, the head installation section is provided so as to be raisable and lowerable on the head supporting frame 34, and is raised and lowered by an elevator mechanism, which is not illustrated. The heads 32 which are installed on the head installation section are raised and lowered perpendicularly with respect to the conveyance surface of the paper P.

The head supporting frame movement mechanism (not illustrated) causes the head supporting frame 34 to slide horizontally in a direction which is perpendicular to the direction of conveyance of the paper P, at a position above the paper conveyance mechanism 20.

The head supporting frame movement mechanism is, for example, constituted by a ceiling frame which is disposed horizontally over the paper conveyance mechanism 20, guide rails provided on the ceiling frame, a traveling body which slides over the guide rails, and a drive device which moves this traveling body along the guide rails (for example, a screw feed mechanism, or the like). The head supporting frame 34 is installed on the travelling body and slides horizontally.

The head supporting frame 34 is driven by this head supporting frame movement mechanism, and is provided movably between a prescribed "image recording position" and a "maintenance position".

The head supporting frame 34 is arranged over the paper conveyance mechanism 20 when positioned at the image recording position. By this means, it is possible to carry out printing onto the paper P which has been conveyed by the paper conveyance mechanism 20.

On the other hand, when the head supporting frame 34 is situated at the maintenance position, then it is arranged at the position where the maintenance unit 40 is disposed.

Caps 42 (42C, 42M, 42Y, 42K) which cover the nozzle surfaces 33 of the heads 32 are provided in the maintenance unit 40. When the apparatus is halted for a long period of time, for example, the heads 32 are moved to the position where this maintenance unit 40 is disposed (the maintenance position) and the nozzle surfaces 33 are covered with the caps. By this means, ejection failure due to drying is prevented.

A pressurizing and suctioning mechanism (not illustrated) for pressurizing and suctioning the interior of the nozzles and a cleaning liquid supply mechanism (not illustrated) for supplying cleaning liquid to the interior of the caps 42 are provided in the caps 42. Furthermore, a waste liquid tray 44 is provided at a position below the caps 42. The cleaning liquid supplied to the caps 42 is discarded into this waste liquid tray 44 and is recovered into a waste liquid tank 48 from the waste liquid tray 44 via a waste liquid recovery pipe 46.

The nozzle surface cleaning unit 50 is arranged between the paper conveyance mechanism 20 and the maintenance unit 40. The nozzle surface cleaning unit 50 cleans the nozzle surfaces 33 of the heads 32 while the head supporting frame 34 moves from the maintenance position to the image recording position.

The nozzle surface cleaning unit 50 is composed by a cleaning liquid deposition unit 60 which applies a cleaning liquid to the nozzle surfaces 33 of the respective heads 32, when the head supporting frame 34 is moved from the maintenance position toward the image recording position, and a wiping unit 80 which wipes the nozzle surfaces 33 of the heads 32 onto which cleaning liquid has been applied.

Figure 6:
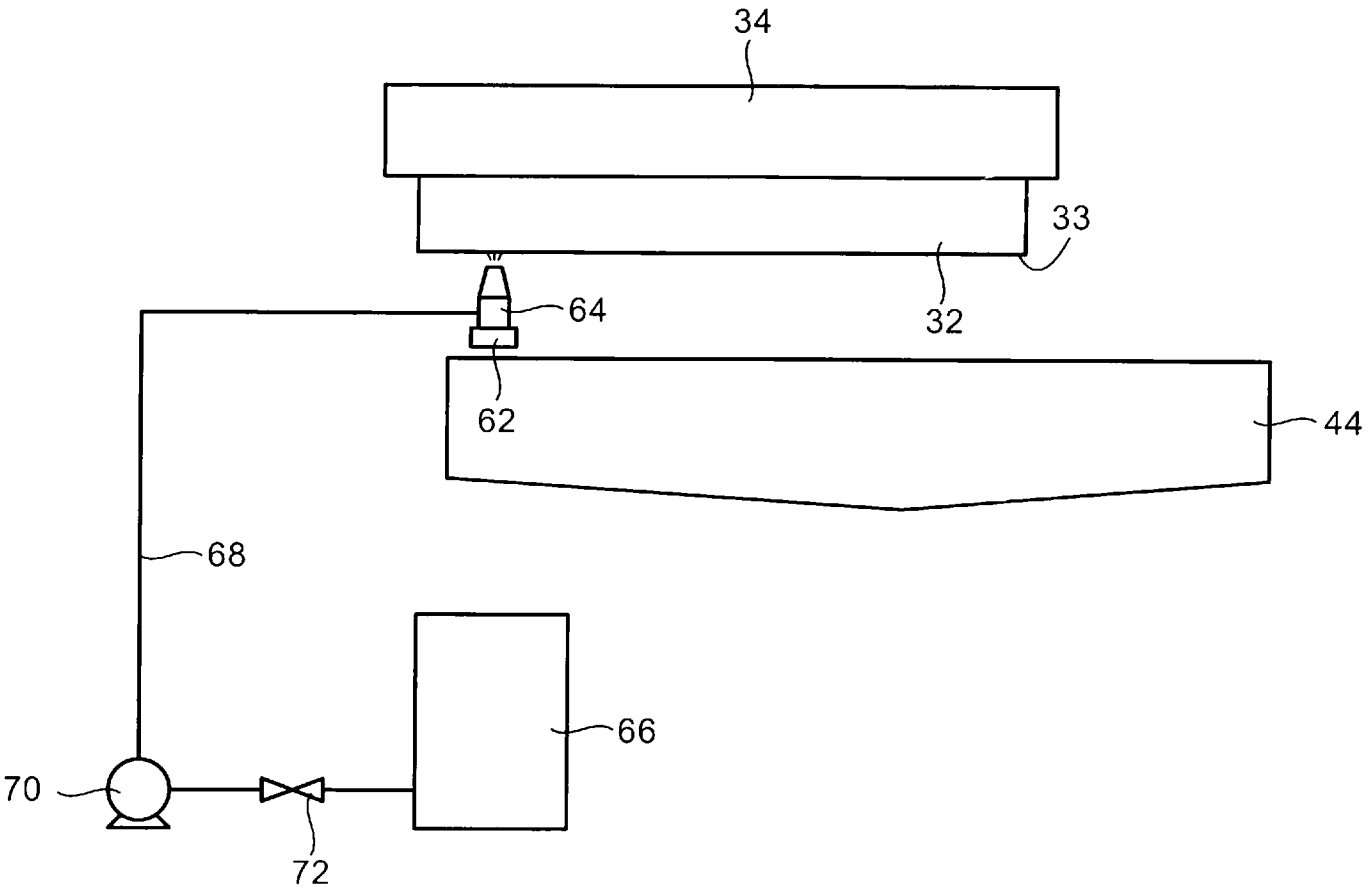
FIG. 6 is a front view diagram showing the general composition of a cleaning liquid deposition unit.

FIG. 6 is a front view diagram showing an approximate composition of a cleaning liquid deposition unit.

As shown in FIG. 6, the cleaning liquid deposition unit 60 is mainly constituted by a cleaning liquid deposition unit main frame 62, cleaning liquid nozzles 64C, 64M, 64Y, 64K which are installed on this cleaning liquid deposition unit main frame 62, a cleaning liquid tank 66 in which cleaning liquid is stored, a cleaning liquid pipe 68 which connects the cleaning liquid tank 66 and the cleaning liquid nozzles 64C, 64M, 64Y, 64K, a cleaning liquid pump 70 which conveys cleaning liquid from the cleaning liquid tank 66 to the cleaning liquid nozzles 64C, 64M, 64Y, 64K, and a cleaning liquid valve 72 which opens and closes the cleaning liquid pipe 68.

The cleaning liquid deposition unit main frame 62 is disposed horizontally over the waste liquid tray 44.

The cleaning liquid nozzles 64C, 64M, 64Y, 64K are provided for each respective head and are installed on the cleaning liquid deposition unit main frame 62 in accordance with the installation pitch of the heads 32.

The cleaning liquid nozzles 64C, 64M, 64Y, 64K each have the same composition and are therefore referred to as cleaning liquid nozzles 64 below, unless a specific cleaning liquid nozzle is to be distinguished.

Each cleaning liquid nozzle 64 has an ejection port of a width corresponding to the width of the nozzle surface 33, and sprays cleaning liquid from this ejection port. The cleaning liquid nozzles 64 are disposed on the cleaning liquid deposition unit main frame 62 so as to spray cleaning liquid upwards.

When the heads 32 pass over the cleaning liquid nozzles 64, the cleaning liquid sprayed out from the ejection port strikes the nozzle surface 33, thereby moistening the nozzle surface 33 (depositing cleaning liquid onto the nozzle surface 33).

The cleaning liquid nozzles 64 are each connected to the cleaning liquid tank 66 via the cleaning liquid pipe 68. The cleaning liquid pump 70 is provided at an intermediate point of the cleaning liquid pipe 68, and sends the cleaning liquid stored in the cleaning liquid tank 66 to each of the cleaning liquid nozzles 64. The cleaning liquid valve 72 is provided at an intermediate point of the cleaning liquid pipe 68, whereby the channel of the cleaning liquid pipe 68 is opened and closed.

It is possible to adopt a composition where a cleaning liquid pump is provided individually for each cleaning liquid nozzle, or a composition where a single cleaning liquid pump is used commonly for all of the cleaning liquid nozzles. The same applies to the cleaning liquid valve.

The cleaning liquid deposition unit 60 has the composition described above. The operation of the cleaning liquid deposition unit 60 is controlled by means of a controller (not illustrated) which controls the whole of the inkjet recording apparatus. The controller controls the deposition of the cleaning liquid by controlling driving of the cleaning liquid pump 70 and the cleaning liquid valve 72.

Cleaning liquid having a main component of diethylene monobutyl ether, for example, is used as the cleaning liquid. By applying a cleaning liquid of this type to the nozzle surfaces 33, it is possible to readily dissolve and remove solid attached matter originating from the ink which has adhered to the nozzle surfaces 33.

Figure 7:
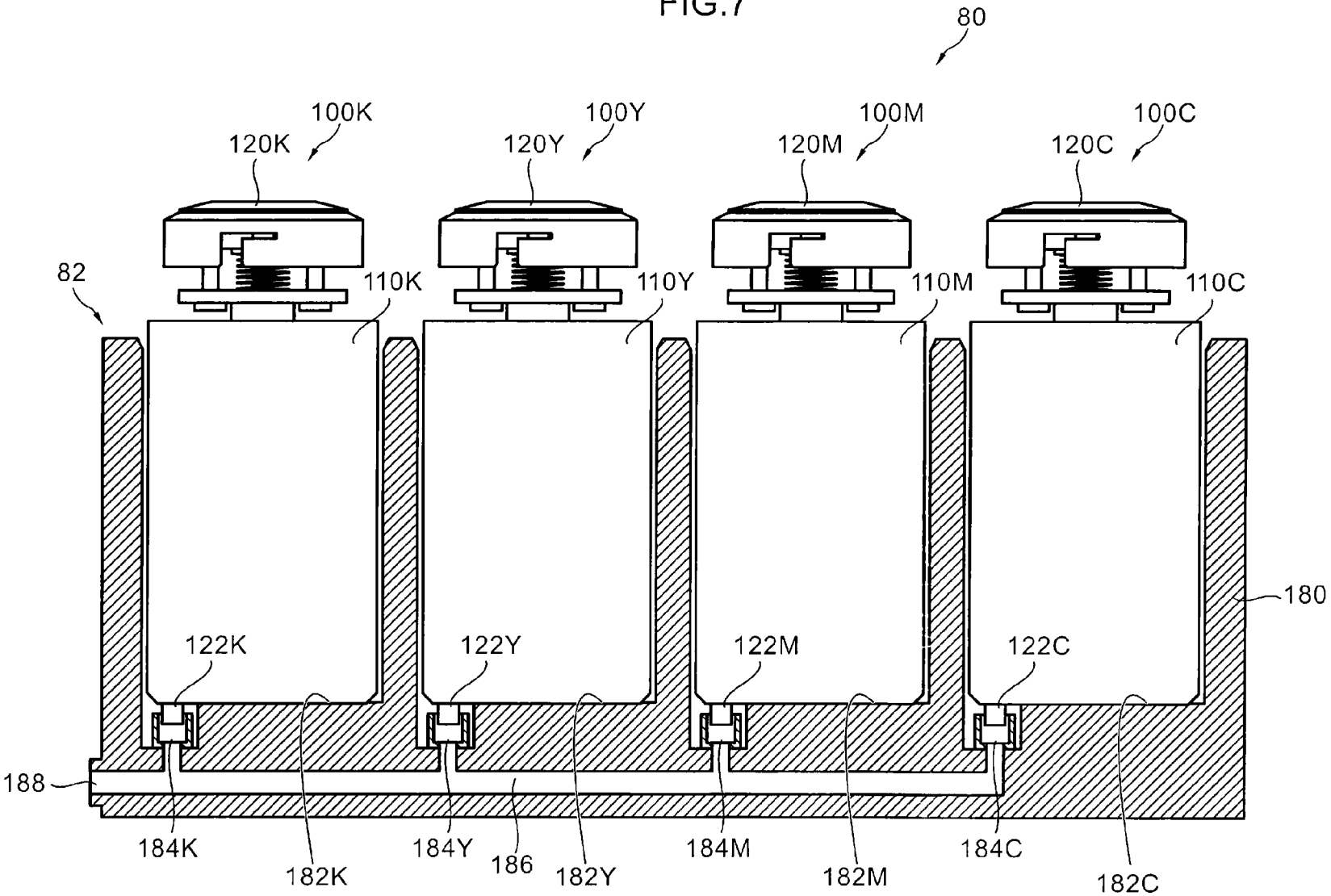
FIG. 7 is a partial cross-sectional side face diagram showing the general composition of a wiping unit.

FIG. 7 is a side view diagram showing an approximate composition of a wiping unit.

The wiping unit 80 is principally constituted by wiping apparatuses 100C, 100M, 100Y, 100K which wipe the nozzle surfaces 33C, 33M, 33Y, 33K of the heads 32C, 32M, 32Y, 32K, and a wiping unit main body 82 in which the wiping apparatuses 100C, 100M, 100Y, 100K are installed.

The wiping apparatuses 100C, 100M, 100Y, 100K respectively abut a wiping pad formed in a circular disk shape against the nozzle surfaces 33 of the heads 32 while causing the wiping pad to rotate, thereby wiping the nozzle surfaces 33. The wiping apparatuses 100C, 100M, 100Y, 100K are provided for each respective head and are arranged on the wiping unit main frame 82 in accordance with the installation pitch of the heads 32. The wiping apparatuses 100C, 100M, 100Y, 100K all have the same composition and therefore the composition is described here with respect to one wiping apparatus 100.

Figure 8:
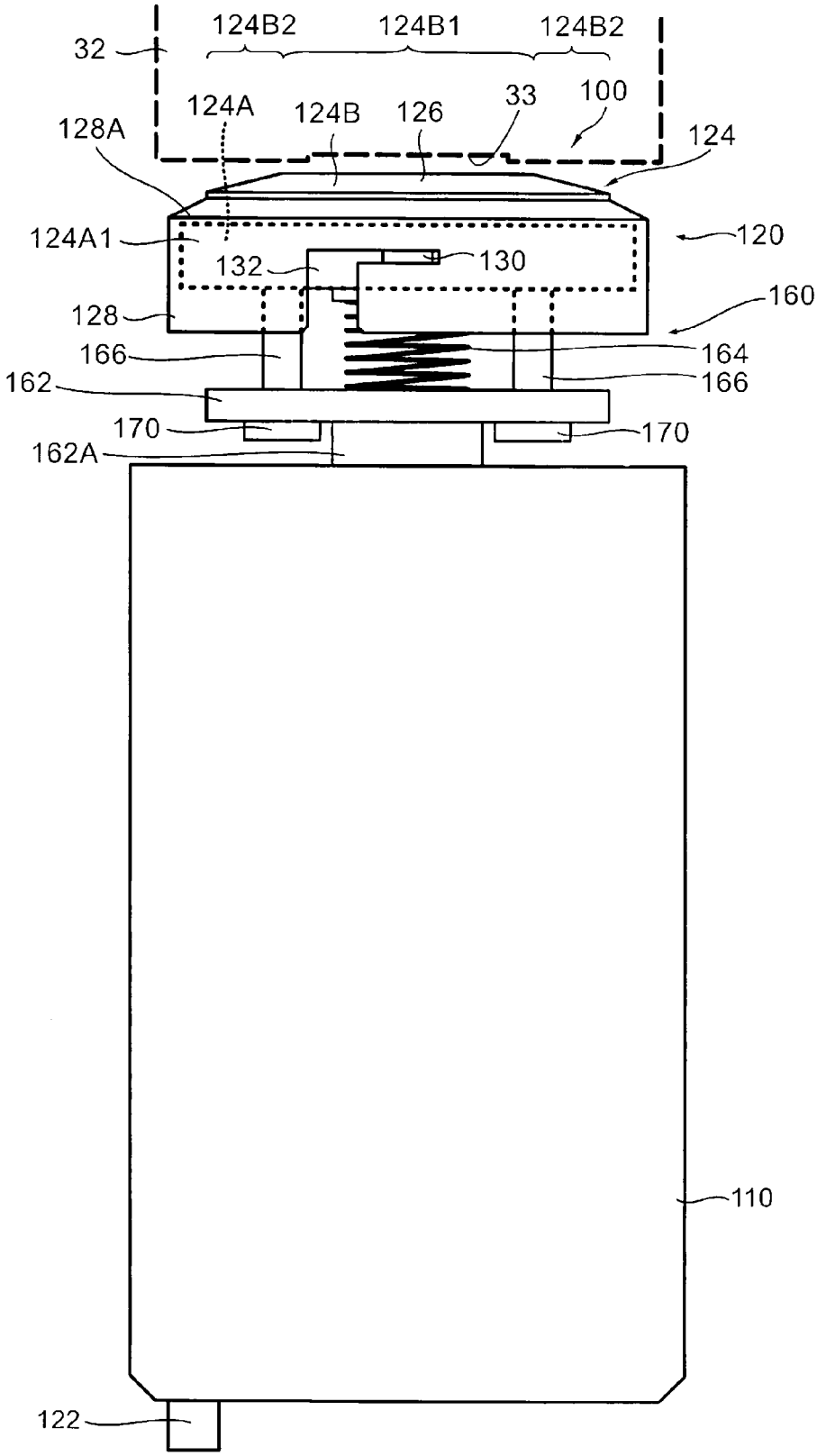
FIG. 8 is a front surface diagram of a wiping apparatus.
Figure 9:
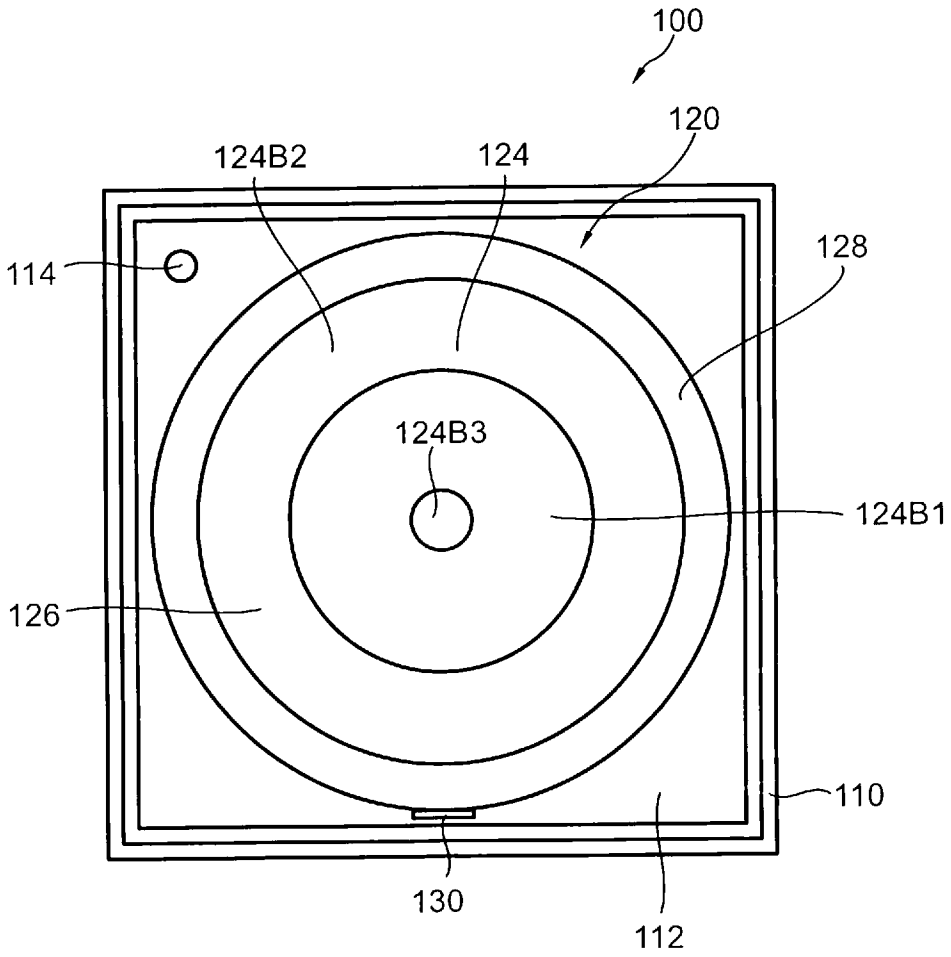
FIG. 9 is a plan diagram of a wiping apparatus.

FIG. 8 and FIG. 9 respectively show a front view and a plan view of a wiping apparatus. Furthermore, FIG. 10 and FIG. 11 are respectively a front side cross-sectional diagram and a side view cross-sectional diagram of a wiping apparatus.

Figure 10:
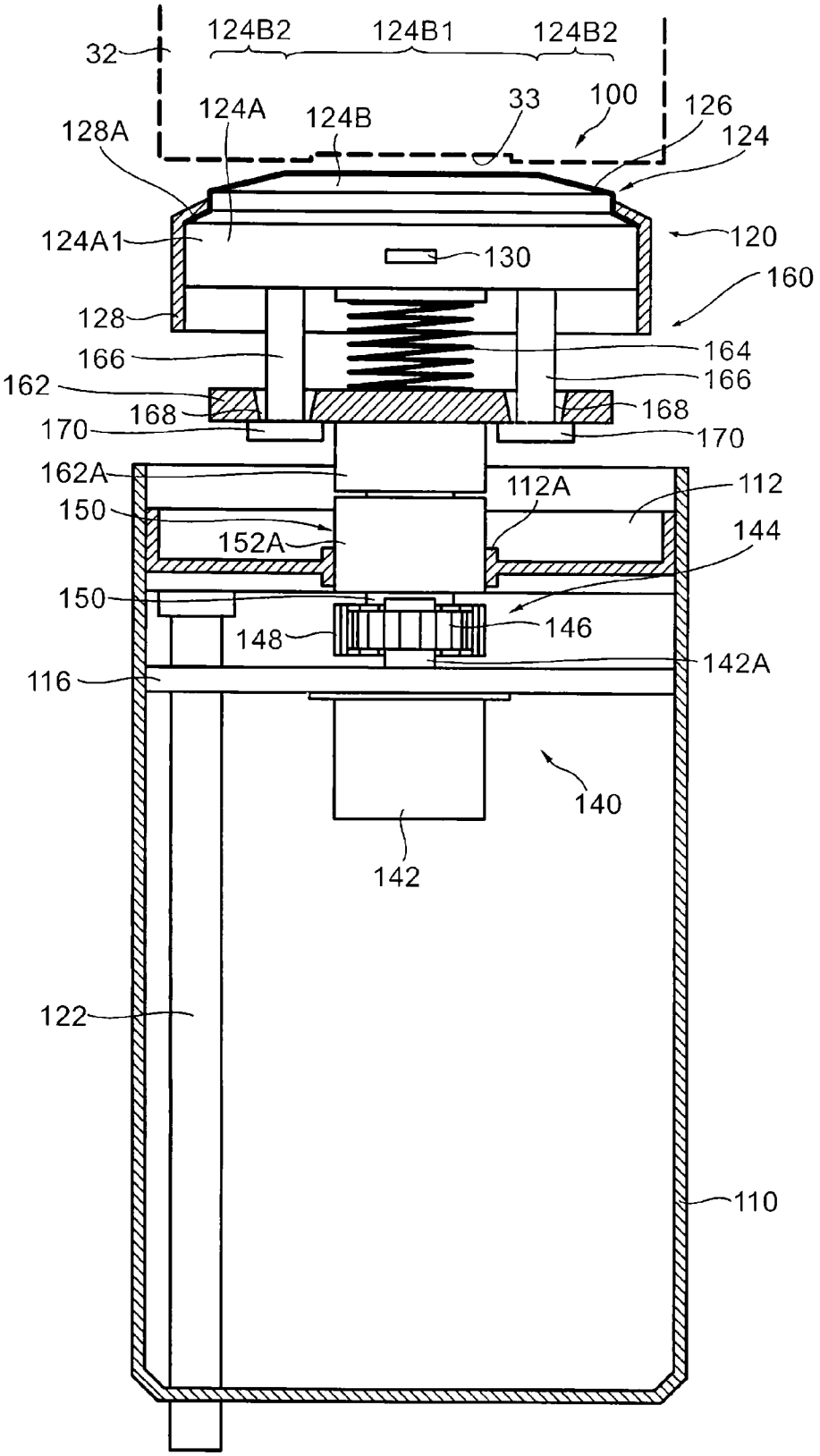
FIG. 10 is cross-sectional front surface diagram of a wiping apparatus.
Figure 11:
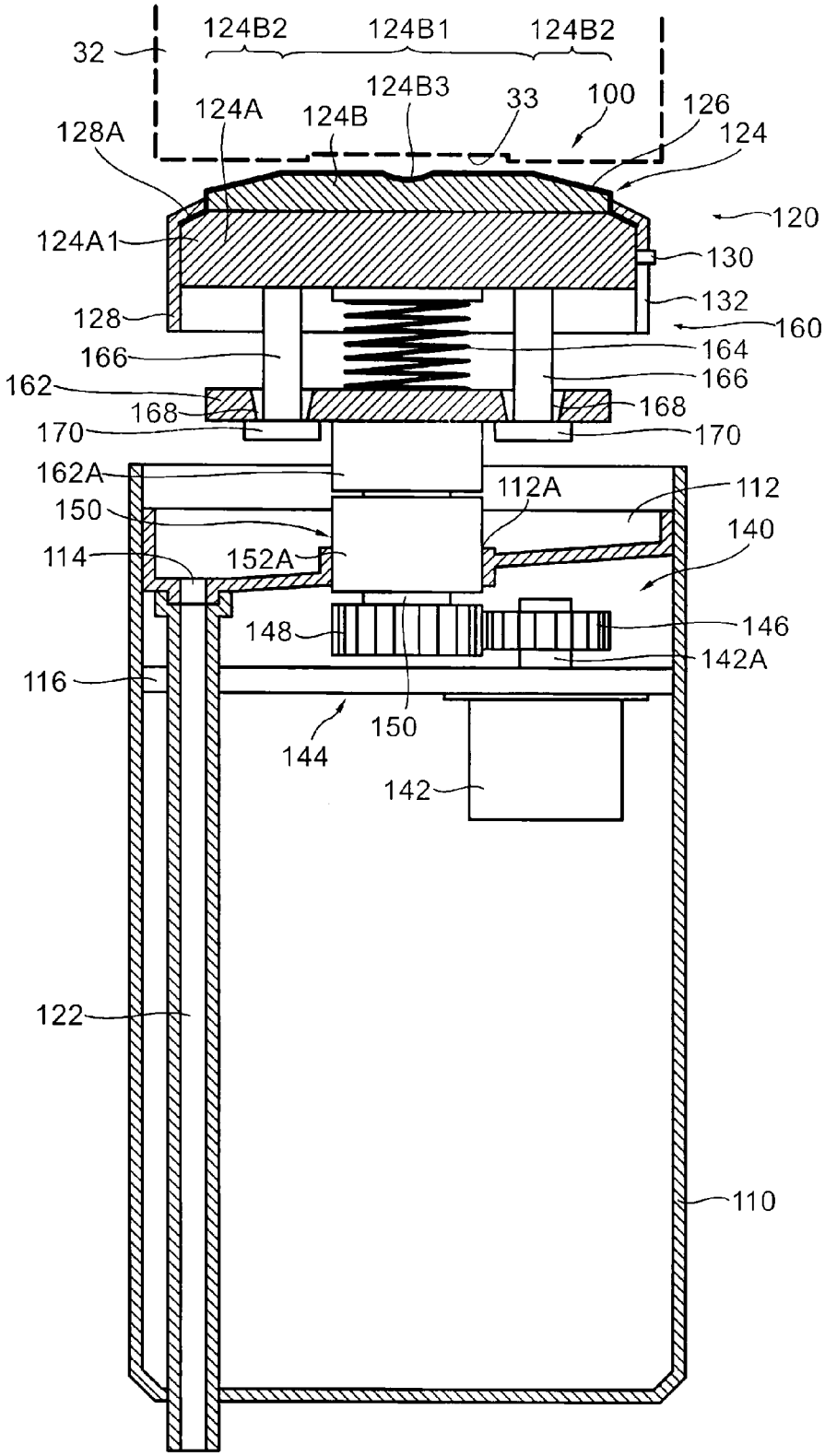
FIG. 11 is a cross-sectional side face of a wiping apparatus.

As shown in FIG. 10 and FIG. 11, the wiping apparatus 100 includes a wiping apparatus main case 110, and provided in this wiping apparatus main case 110, a wiping pad 120, a rotational drive mechanism 140 which causes the wiping pad 120 to rotate, and a suspension mechanism 160 which displaces the wiping pad 120 in an axial direction.

The wiping apparatus main case 110 is formed in a rectangular box shape which is long in the vertical direction, the upper portion thereof being open.

A tray 112 is disposed in the vicinity of the upper end portion of the interior of the wiping apparatus main body case 110. The tray 112 is disposed so as to close off the upper opening portion of the wiping apparatus main case 110, the bottom portion thereof being formed in an inclined fashion with respect to the rear surface side of the wiping apparatus main case 110. Cleaning liquid which drips down from the wiping pad 120 during wiping is recovered in this tray 112.

A waste liquid outlet 114 is formed in the tray 112 on the lower side in the direction of inclination. The cleaning liquid recovered in the tray 112 is expelled from this waste liquid outlet 114.

A waste liquid pipe 122 which is disposed inside the wiping apparatus main case 110 is connected to the waste liquid outlet 114. The waste liquid pipe 122 is disposed so as to extend to the lower side from the waste liquid outlet 114, and the lower end portion thereof is disposed so as to project from the lower surface portion of the wiping apparatus main case 110. As described below, when the wiping apparatus 100 is installed in the wiping unit main body 82, the lower end of the waste liquid pipe 122 is connected to the waste liquid outlet formed in the wiping unit main body 82.

The bracket 116 is arranged on the lower side of the tray 112, inside the wiping apparatus main body case 110. As described below, the rotational drive mechanism 140 is installed on this bracket 116.

The wiping pad 120 is formed in a circular disk shape, and the circumferential edge portion thereof is formed in a tapered shape which diverges. This wiping pad 120 is principally constituted by a pad main body 124, a wiping cloth 126 which is installed detachably on the pad main body 124 and covers the surface of the pad main body 124, and a pad cover 128 which fixes the wiping cloth 126 to the pad main body 124.

The pad main body 124 is principally constituted by a base plate 124A and a pad 124B which is arranged on the base plate 124A, and is formed overall in a circular disk shape.

The base plate 124A is formed as a rigid body in a circular disk shape having a prescribed thickness.

The pad 124B is installed on an upper surface portion of the base plate 124A and is integrated with the base plate 124A. The pad 124B is formed in a circular disk shape, and the circumferential edge portion thereof is formed in a tapered shape which diverges. More specifically, the pad 124B is constituted by a central circular section 124B1 and a ring-shaped tapered section (inclined section) 124B2 which is formed about the periphery of the circular section 124B1. The circular section 124B1 is formed in a flat shape. This circular section 124B1 constitutes a section which wipes the nozzle surface 33, and the diameter thereof is formed at least to be larger than the width of the nozzle surface 33 (the width in the direction perpendicular to the lengthwise direction). Furthermore, a hemispherical recess section 124B3 is formed in the central portion of the circular section 124B1. This pad 124B is made of a rubber material having a prescribed hardness (rubber with a hardness of 5° for example) and is formed so as to be elastically deformable.

The pad 124B is formed to a smaller diameter than the base plate 124A. The base plate 124A is provided so as to project in a ring shape from the periphery of the pad 124B. The projecting section 124A1 of the base plate 124A is formed with a tapered shape.

Figure 12:
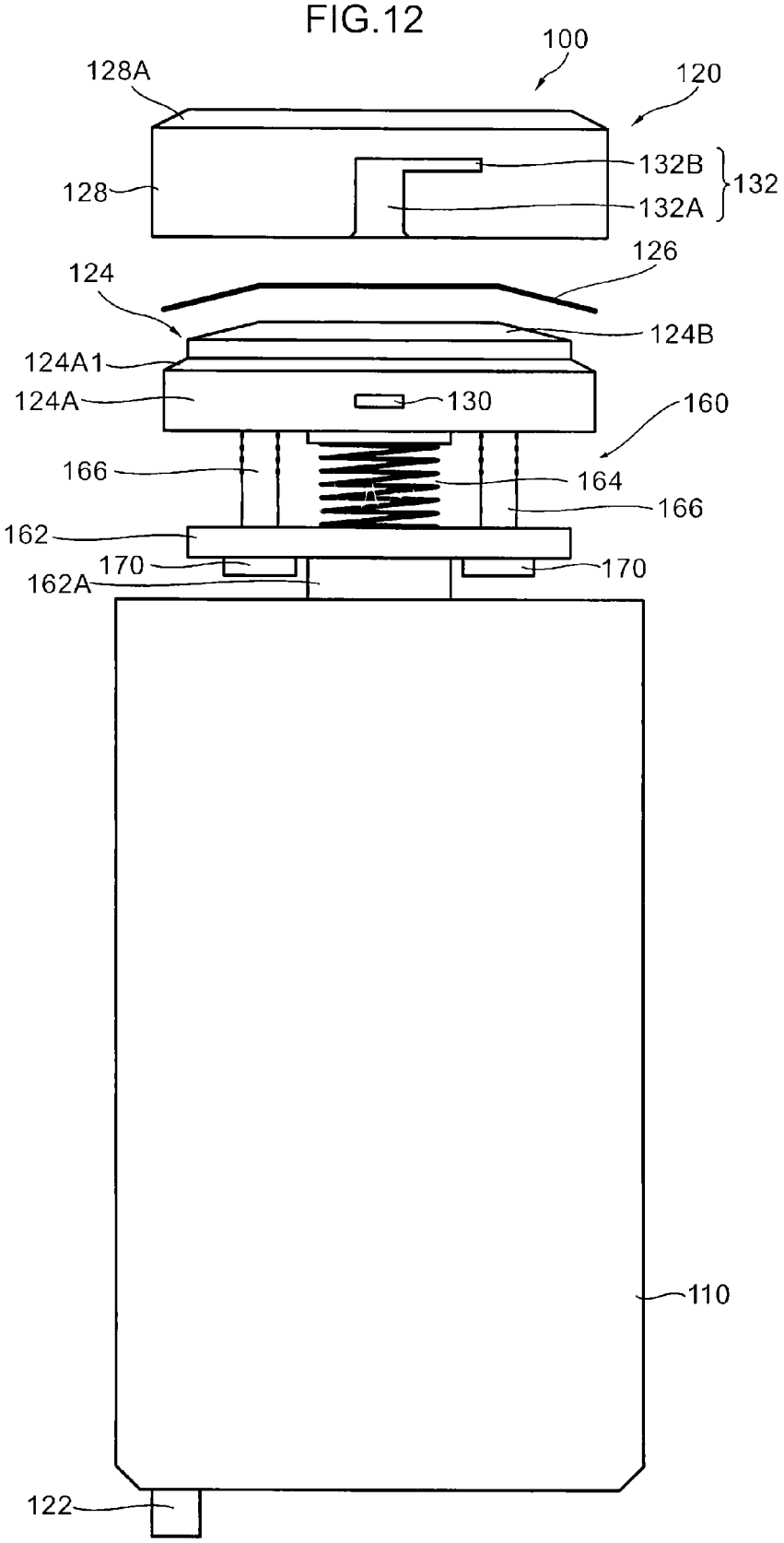
FIG. 12 is an illustrative diagram of a method of installing a wiping cloth.

As shown in FIG. 12, the wiping cloth 126 is formed in a circular shape, and is formed with a diverging shape so as to follow the upper surface shape of the pad main body 124. This wiping cloth 126 is, for example, made of a sheet of knitted or woven micro-fibers, such as PET, PE, NY, or the like.

The pad cover 128 is formed in a tubular shape and a sandwiching section 128A is formed on an upper end portion thereof. The sandwiching section 128A is formed in a ring shape in an inclined fashion following the shape of the projecting section 124A1 of the base plate 124A. The internal diameter of the pad cover 128 is formed to substantially the same diameter as the outer shape of the base plate 124A, and the internal diameter of the sandwiching section 128A is formed to substantially the same diameter as the external shape of the pad 124B. Consequently, when the pad cover 128 is placed over the pad main body 124, the pad main body 124 is accommodated in the pad cover 128 with the pad 124B in an exposed state. In this case, the sandwiching section 128A of the pad cover 128 is mounted on the projecting section 124A1 of the base plate 124A. Consequently, if the wiping cloth 126 is placed over the pad main body 124 and the pad cover 128 is placed further thereon, then the circumferential edge portion of the wiping cloth 126 is sandwiched between the sandwiching section 128A of the pad cover 128 and the projecting section 124A1 of the base plate 124A, and the wiping cloth 126 is fixed to the pad main body 124.

A plate-shaped locking piece 130 is provided in a projecting fashion on the base plate 124A of the pad main body 124.

On the other hand, a locking groove 132 into which this locking piece 130 fits is formed in the pad cover 128. The locking groove 132 is constituted by a vertical section 132A and a horizontal section 132B. The vertical section 132A is formed so as to extend upwards (in an axial direction) from the lower edge portion of the pad cover 128, and is formed to substantially the same width as the locking piece 130. The horizontal section 132B is formed so as to extend sideways (in a circumferential direction) from the upper end of the vertical section 132A, and is formed to substantially the same thickness as the locking piece 130.

When fitting the pad cover 128 onto the pad main body 124, the locking piece 130 is fitted into the vertical section 132A of the locking groove 132, by aligning the position of the locking piece 130 and the position of the vertical section 132A of the locking groove 132 and fitting the vertical section 132A therein. When the pad cover 128 is fitted onto the pad main cover 124 as described above, the sandwiching section 128A of the pad cover 128 abuts against the projecting section 124A1 of the base plate 124A. Simultaneously with this, the locking piece 130 arrives at the upper end of the vertical section 132A of the locking groove 132. When the pad cover 128 is rotated in a circumferential direction in this state, the locking piece 130 fits into the horizontal section 132B of the locking groove 132. By rotating the pad cover 128 until the locking piece 130 arrives at the front end of the horizontal section 132B of the locking groove 132, the pad cover 128 is locked onto the pad main body 124. Furthermore, by this means, the wiping cloth 126 is fixed to the pad main body 124.

The rotational drive mechanism 140 is principally constituted by a pad rotation motor 142, and a rotation transmission mechanism 144 which transmits the rotation of this pad rotation motor 142.

The pad rotation motor 142 is installed on the lower surface portion of the bracket 116. The pad rotation motor 142 is arranged with the output axis 142A facing vertically upwards, and is disposed so as to project on the upper side of the bracket 116.

The rotation transmission mechanism 144 is principally constituted by a drive gear 146 which is installed on an output shaft of the pad rotation motor 142, an idle gear 148 which meshes with the drive gear 146, a drive shaft 150 on which the idle gear 148 is installed, and a coupling 152 which links the drive shaft 150 and a rotating shaft 162A of a rotating base 162 which is described below.

The drive gear 146 is installed on an output shaft of the pad rotation motor 142.

The idle gear 148 is installed on the drive shaft 150 and meshes with the drive gear 146.

The drive shaft 150 is connected to an input shaft (not illustrated) of the coupling 152 and is supported rotatably.

The coupling 152 is installed on a tray 112. A coupling installation section 112A for installing the coupling 152 is provided on the tray 112. The coupling installation section 112A is provided in the center of the tray 112, as a circular opening section. The coupling 152 is installed on the tray 112 by fitting the coupling 152 into the coupling installation section 112A in a liquid-tight state.

The coupling 152 has a cylindrical case 152A and an input shaft and an output shaft (not illustrated) are disposed inside the case 152A. The input shaft and the output shaft are supported rotatably on bearings (not illustrated) which are arranged inside the case, and are connected so as to be able to transmit rotation therebetween.

As described above, the drive shaft 150 is connected to the input shaft of the coupling 152. Consequently, the input shaft is rotated by turning the drive shaft 150. If the input shaft is rotated, this rotation is transmitted to the output shaft, and the output shaft rotates.

The suspension mechanism 160 is principally constituted by a rotating base 162, an biasing spring 164 and four sliding rods 166.

The rotating base 162 is formed in a circular disk shape and is arranged horizontally (in parallel with the nozzle surface 33). The rotating shaft 162A is coupled on the lower surface of the rotating base 162. The rotating shaft 162A is coupled coaxially to the rotating base 162.

The rotating shaft 162A is arranged vertically (perpendicularly with respect to the nozzle surface 33), and is installed detachably on the output shaft (not illustrated) of the coupling 152. Consequently, when the output shaft of the coupling 152 turns, the rotating shaft 162A rotates. As a result of this, the rotating base 162 turns about a vertical axis (about an axis perpendicular to the nozzle surface 33).

The biasing spring 164 is constituted by a coil spring and is arranged vertically (perpendicularly with respect to the nozzle surface 33). One end (the upper end) of the biasing spring 164 is coupled to the center of the lower surface of the wiping pad 120 (the lower surface of the base plate 124A of the pad main body 124), and the other end thereof (the lower end) is coupled to the center of the upper surface of the rotating base 162.

The sliding rod 166 is formed in a round bar shape and is provided in an integrated fashion on the wiping pad 120. More specifically, the sliding rod 166 is provided an integrated fashion on the lower surface of the base plate 124A of the pad main body 124 which constitutes the wiping pad 120. The sliding rods 166 are arranged at a uniform intervals apart (at 90° intervals apart) coaxially with the center of the base plate 124A, so as to extend vertically downwards from the lower surface of the base plate 124A.

In the rotating base 162, guide holes 168 into which the sliding rods 166 are inserted are formed at four positions corresponding to the forming positions of the sliding rods 166. The sliding rods 166 are introduced into the guide holes 168 formed in the rotating base 162.

The guide holes 168 are formed in a tapered shape with the upper end side (wiping pad side) having a broad dimension. Furthermore, the internal diameter of the lower end portion of each guide hole 168 is formed to substantially the same diameter as (or slightly larger than) the external diameter of the sliding rods 166, so as to be able to support the sliding rods 166 slidably.

A retaining plate 170 is also provided on the front end of each sliding rod 166 which is inserted into a guide hole 168. The retaining plate 170 is formed in a circular disk shape and is formed to be larger than the internal diameter of the lower end portion of the guide holes 168.

Here, the biasing spring 164 is installed between the rotating base 162 and the base plate 124A so as to be compressed by a prescribed amount when in a normal state. Consequently, in a normal state, the retaining plate 170 makes tight contact with the lower surface of the rotating base 162.

When the wiping pad 120 is pressed downwards, the wiping pad 120 descends against the biasing force of the biasing spring 164. When this pressing force is released, the wiping pad 120 reverts to its original position due to the biasing force of the biasing spring 164. In this way, the wiping pad 120 is provided so as to be upwardly and downwardly movable due to impulsion by the biasing spring 164.

In so doing, the wiping pad 120 moves upwards and downwards while the sliding rods 166 are guided by the guide holes 168.

Figure 13B:
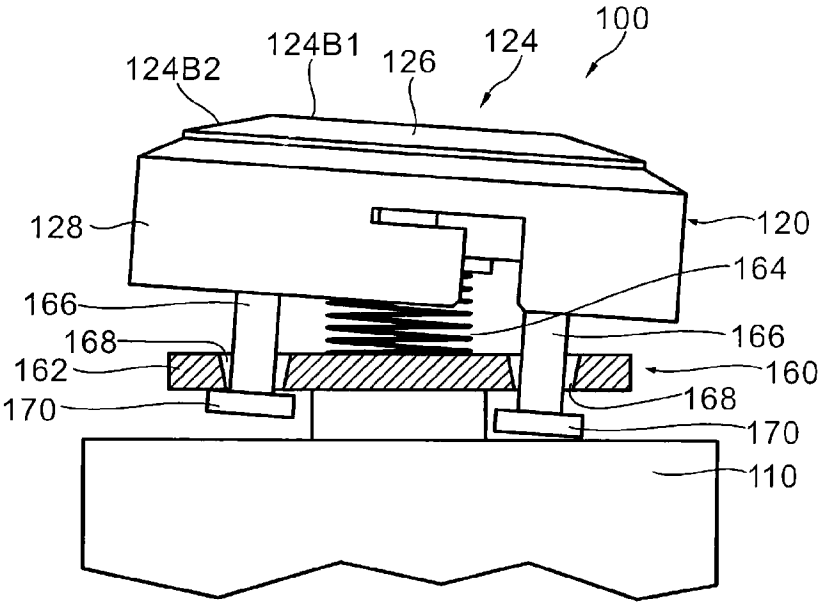
FIGS. 13A and 13B are illustrative diagrams of the operation of a suspension mechanism.
Figure 13A:
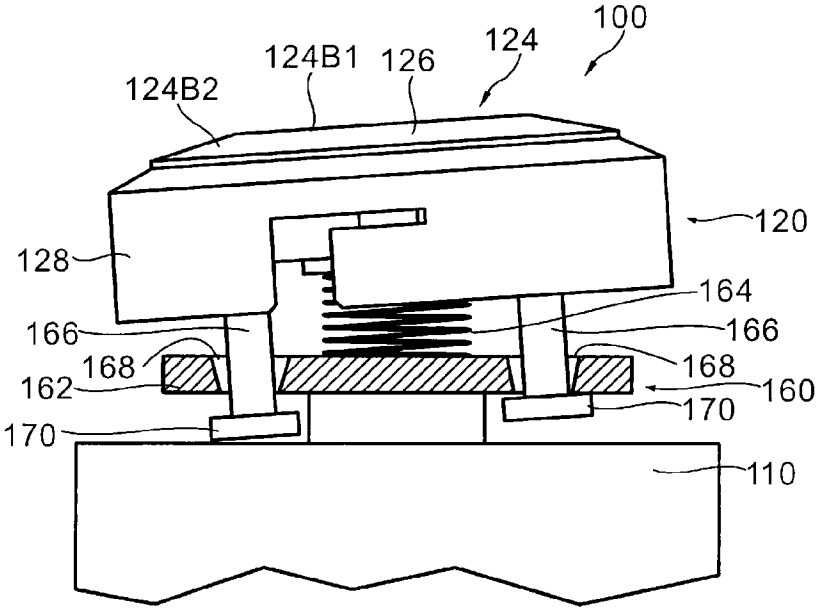

Here, as described above, the guide holes 168 are formed so as to broaden towards the upper end portions. Therefore, the sliding rods 166 are held in an inclinable fashion in a prescribed angular range. As a result of this, as shown in FIGS. 13A and 13B, as well being held movably upwards and downwards, the wiping pad 120 is also held in an oscillatable fashion. By this means, it is possible to cause the wiping pad 120 to make tight contact readily with the nozzle surface 33.

The wiping apparatus 100 has the composition described above. In the wiping apparatus 100, the wiping pad 120 rotates about a vertical axis (about an axis perpendicular to the nozzle surface 33) by driving the pad rotation motor 142. By abutting this rotating wiping pad 120 against the nozzle surface 33, the nozzle surface 33 is wiped.

The wiping unit main body 82 is principally constituted by a wiping unit main case 180 which accommodates the wiping apparatuses 100C, 100M, 100Y, 100K, and an elevator apparatus (not illustrated) which raises and lowers the wiping unit main case 180.

The wiping unit main case 180 is formed in a parallelepiped box shape, and wiping apparatus accommodating sections 182C, 182M, 182Y, 182K which accommodate the wiping apparatuses 100C, 100M, 100Y, 100K are formed therein. The wiping apparatus accommodating sections 182C, 182M, 182Y, 182K are formed as recess sections which can accommodate the wiping apparatuses 100C, 100M, 100Y, 100K in the longitudinal direction, the upper portions thereof being open. Furthermore, the wiping apparatus accommodating sections 182C, 182M, 182Y, 182K are arranged on a straight line at the same interval apart as the installation pitch of the heads 32 which are installed on the head supporting frame 34. The wiping apparatuses 100C, 100M, 100Y, 100K are accommodated in a vertically erect state in the wiping apparatus accommodating sections 182C, 182M, 182Y, 182K.

When the wiping apparatuses 100C, 100M, 100Y, 100K are accommodated in the wiping apparatus accommodating sections 182C, 182M, 182Y, 182K, the wiping pads 120C, 120M, 120Y, 120K are exposed via the wiping apparatus accommodating sections 182C, 182M, 182Y, 182K. Furthermore, the wiping pads 120C, 120M, 120Y, 120K are held in a horizontal state (a state parallel to the nozzle surface 33 of the head 32).

Couplers 184C, 184M, 184Y, 184K are provided in the bottom portions of the wiping apparatus accommodating sections 182C, 182M, 182Y, 182K. When the wiping apparatuses 100C, 100M, 100Y, 100K are accommodated in the wiping apparatus accommodating sections 182C, 182M, 182Y, 182K, the waste liquid pipes 122C, 122M, 122Y, 122K provided in the wiping apparatuses 100C, 100M, 100Y, 100K are connected to the couplers 184C, 184M, 184Y, 184K.

A waste liquid channel 186 formed inside the wiping unit main body 82 is connected to the couplers 184C, 184M, 184Y, 184K. The waste liquid channel 186 is connected to a waste liquid pipe connection port 188 which is formed in the wiping unit main body 82. A waste liquid pipe (not illustrated) is connected to the waste liquid pipe connection port 188. The waste liquid pipe is connected to the waste liquid tank 48.

The cleaning liquid which drips down from the wiping pads 120C, 120M, 120Y, 120K and is recovered in the trays 112C, 112M, 112Y, 112K is recovered into the waste liquid tank 48 via the waste liquid pipes 122C, 122M, 122Y, 122K, the couplers 184C, 184M, 184Y, 184K, and the waste liquid pipe.

The elevator apparatus raises and lowers the wiping unit main case 180 in a vertical direction. The wiping apparatuses 100C, 100M, 100Y, 100K accommodated in the wiping unit main case 180 are moved between a prescribed "wiping position" and "standby position", by raising and lowering the wiping unit main case 180 by this elevator apparatus.

When the wiping apparatuses 100C, 100M, 100Y, 100K are moved to the "wiping position", the wiping pads 120C, 120M, 120Y, 120K are located in positions where they can abut against the nozzle surfaces 33C, 33M, 33Y, 33K of the heads 32C, 32M, 32Y, 32K which are moved between the "image recording position" and the "maintenance position". On the other hand, when the wiping apparatuses 100C, 100M, 100Y, 100K are moved to the "standby position", the wiping pads 120C, 120M, 120Y, 120K are located in positions where they cannot abut against the nozzle surfaces 33C, 33M, 33Y, 33K of the heads 32C, 32M, 32Y, 32K which are moved between the "image recording position" and the "maintenance position".

<Action of Inkjet Recording Apparatus>

Next, an action of the inkjet recording apparatus 10 according to the present embodiment will be described.

[Image Recording Method]

To begin with, an image recording method using the inkjet recording apparatus 10 according to the present embodiment will be described.

Firstly, as a preparation prior to image recording, the head supporting frame 34 is moved to an image recording position. By this means, the heads 32 are set over the paper conveyance mechanism 20 and image recording is possible.

The paper P is supplied to the paper conveyance mechanism 20 by a paper supply mechanism, which is not illustrated. According to requirements, prescribed pre-treatment (for example, application of a prescribed treatment liquid, or the like) is carried out.

The paper conveyance mechanism 20 receives paper P supplied by the paper supply mechanism and conveys the paper horizontally.

The heads 32 record an image on the surface of the paper P by ejecting ink droplets toward the paper P which is conveyed by the paper conveyance mechanism 20.

The paper P on which an image has been recorded is recovered by a recovery mechanism, which is not illustrated. According to requirements, processing such as drying, fixing, or the like, is carried out.

By supplying paper P continuously, an image recording process is carried out continuously.

[Nozzle Surface Cleaning Method]

Next, a method of cleaning the nozzle surfaces 33 according to the inkjet recording apparatus 10 of the present embodiment will be described.

As described above, in the inkjet recording apparatus according to the present embodiment, the nozzle surfaces 33 are cleaned by using the movement of the heads 32 when the head supporting frame 34 moves from a maintenance position to an image recording position.

Firstly, the controller drives the elevator apparatus and moves the wiping apparatuses 100, which are situated in the standby position, to an operating position. Accordingly, when the heads 32 are moved from the maintenance position to the image recording position, it is possible to abut the wiping pads 120 against the nozzle surfaces 33 of the heads 32.

Figure 14A:
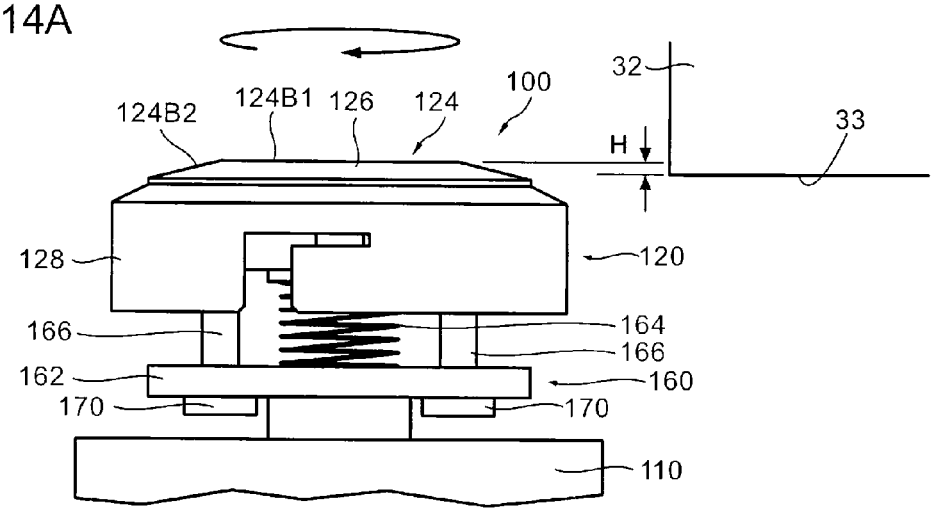
FIGS. 14A to 14C are illustrative diagrams of a wiping operation by a wiping pad.

Here, as shown in FIG. 14A, when the wiping apparatuses 100 are located in the operating position, the upper surface of each wiping pad 120 (the circular section 124B1 of the pad main body 124) is arranged at a position at a prescribed height (H) above lower surface (nozzle surface 33) of the head 32 (in other words, so as to overlap with the nozzle surface 33). In other words, each wiping apparatus 100 is arranged in such a manner that the lower surface (nozzle surface 33) of the corresponding head 32 is positioned between the tapered sections (inclined sections) 124B2 of the pad main body 124.

Next, the controller causes the head supporting frame 34 which is situated in the maintenance position to move at a uniform speed towards the image recording position.

Thereupon, the controller opens the cleaning liquid valve 72 and also drives the cleaning liquid pump 70 in accordance with the timing at which the front ends of the heads 32 (here, the ends adjacent to the image recording position) arrive at the cleaning liquid nozzles 64. By this means, cleaning liquid is sprayed from the cleaning liquid nozzles 64. When the heads 32 pass over the cleaning liquid nozzles 64 from which cleaning liquid has been sprayed, the cleaning liquid sprayed from the cleaning liquid nozzles 64 makes contact with the nozzle surfaces 33 and the cleaning liquid is deposited onto the nozzle surfaces 33 (the nozzle surfaces 33 are moistened).

Furthermore, the controller drives the pad rotation motor 142 in accordance with the timing at which the front ends of the heads 32 arrive at the wiping apparatuses 100. Consequently, the wiping pads 120 rotate at a uniform velocity. When the heads 32 pass over the wiping apparatuses 100, the rotating wiping pads 120 abut against the nozzle surfaces 33, thereby wiping the nozzle surfaces 33.

Here, as described above, the wiping pads 120 are each located at a position where the upper surface of the pad (the circular portion 124B1 of the pad main body 124) is higher than the position of the lower surface (nozzle surface 33) of the head 32.

Figure 14B:
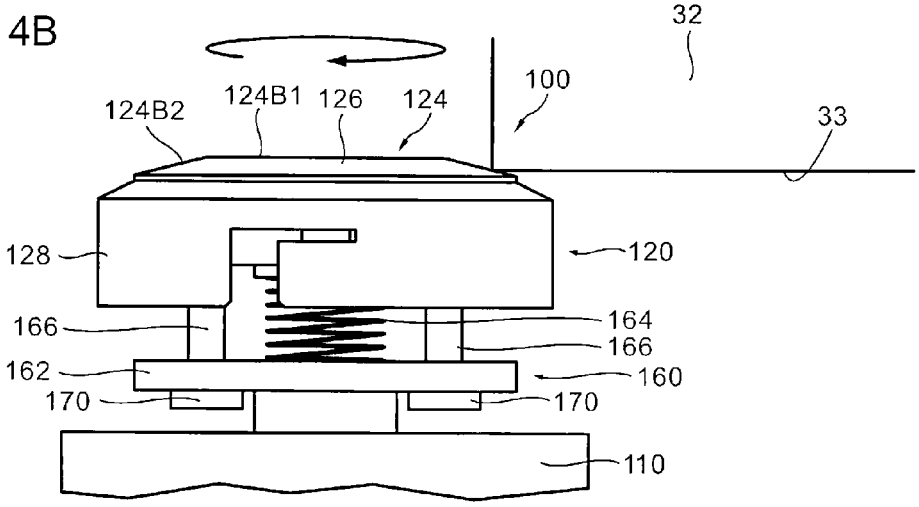

However, since the tapered section 124B2 is formed in the circumferential edge section of the wiping pad 120, and the wiping pad 120 is held movably upwards and downwards by the suspension mechanism 160, then when the corresponding head 32 reaches the wiping pad 120, the wiping pad 120 can be pressed down by the front end of the head 32, as shown in FIG. 14B.

Furthermore, since the front end of the head 32 abuts against the tapered section 124B2, the wiping pad 120 receives force in a thrust direction, but because the wiping pad 120 is supported oscillatably and is abutted while rotating, then this thrust force is able to escape. By this means, it is possible to abut the wiping pad 120 against the nozzle surface 33 of the head 32 without applying undue force.

Figure 14C:
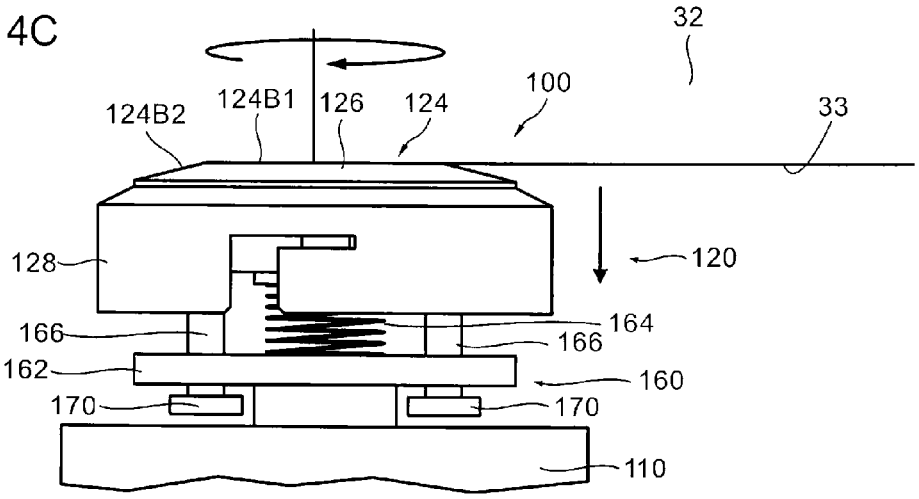

When the front end of the head 32 rides up over the taper section 124B2, as shown in FIG. 14C, the circular section 124B1 of the wiping pad 120 makes tight contact with the nozzle surface 33. In so doing, the wiping pad 120 is pressed against the nozzle surface 33 with a prescribed pressure by the biasing force of the biasing spring 164. Consequently, it is possible to abut the wiping pad 120 against the nozzle surface 33, in a stable fashion, without applying undue force.

Furthermore, since the wiping pad 120 is abutted against the nozzle surface 33 while rotating, then the wiping pad 120 is wiped in multiple directions. Consequently, it is possible effectively to prevent deterioration of the lyophobic film, or adhering material from being pushed inside the nozzles, due to wiping in one direction only.

Moreover, since the recess section 124B3 is formed in the center of the wiping pad 120 (the center of the circular section 124B1), then it is possible to wipe the whole of the nozzle surface uniformly, while eliminating the effects of wiping in the same location.

As described above, cleaning liquid is deposited onto the nozzle surface 33, which is then wiped in a moistened state. Therefore, the cleaning liquid drips down from the wiping pad 120 as wiping is performed. The cleaning liquid which has dripped down from the wiping pad 120 is recovered in the tray 112 and is recovered into the waste liquid tank 48 via the waste liquid pipe 122. By this means, it is possible to wipe the nozzle surface 33 in a clean state, without scattering the cleaning liquid to the peripheral area.

The controller halts the driving of the cleaning liquid pump 70 and closes the cleaning liquid valve 72, in accordance with the timing at which the rear ends of the heads 32 (here, the ends adjacent to the maintenance position) pass the cleaning liquid nozzles 64. By this means, the spraying of cleaning liquid is halted.

Furthermore, the controller halts the driving of the pad rotation motor 142 in accordance with the timing at which the rear ends of the heads 32 pass the wiping apparatuses 100. By this means, the rotation of the wiping pads 120 is halted.

Figure 15A:
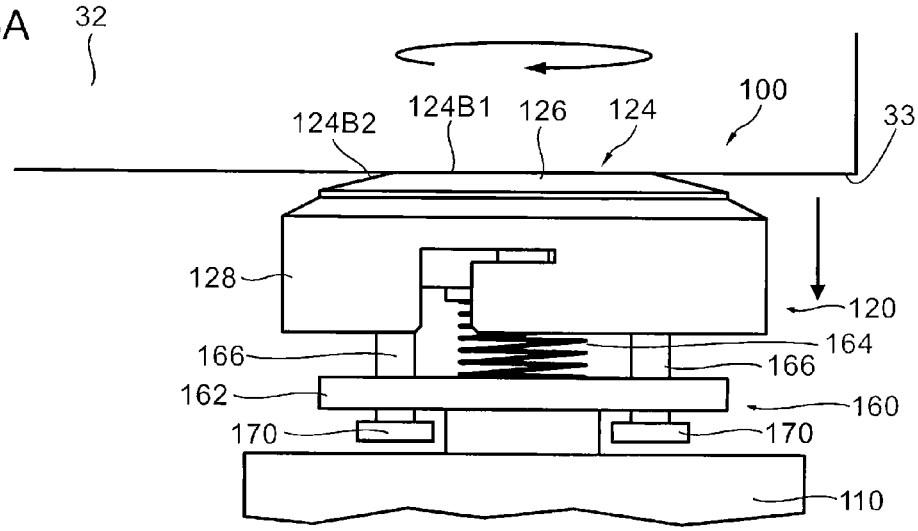
FIGS. 15A to 15C are illustrative diagrams of a wiping operation by a wiping pad.

Here, as shown in FIG. 15A, each wiping pad 120 is pushed against the nozzle surface 33 of the head 32 and continues to rotate at a prescribed position, while the rear end of the head 32 is passing the circular section 124B1 of the wiping pad 120.

Figure 15B:
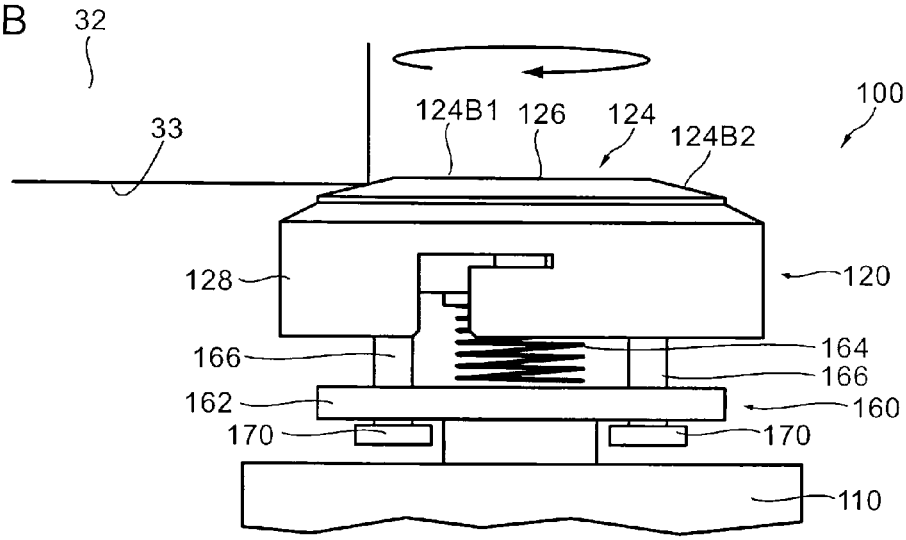

On the other hand, when the rear end of the head 32 has passed the circular section 124B1 of the wiping pad 120, as shown in FIG. 15B, then the tapered section 124B2 abuts against the rear end of the head 32, and rises up gradually due to the biasing force of the biasing spring 164, following the tapered section 124B2. Consequently, it is possible to abut the wiping pad 120 against the nozzle surface 33 in a stable fashion, up to the very end (rear end) of the nozzle surface 33.

Furthermore, since the wiping pad 120 is separated from the nozzle surface 33 while rotating, then it is possible to separate the wiping pad 120 from the nozzle surface 33 without causing unnecessary vibrations. Consequently, the cleaning liquid can be prevented from splattering during separation, and soiling of the nozzle surface 33 after cleaning due to such splattered cleaning liquid can be prevented.

Figure 15C:
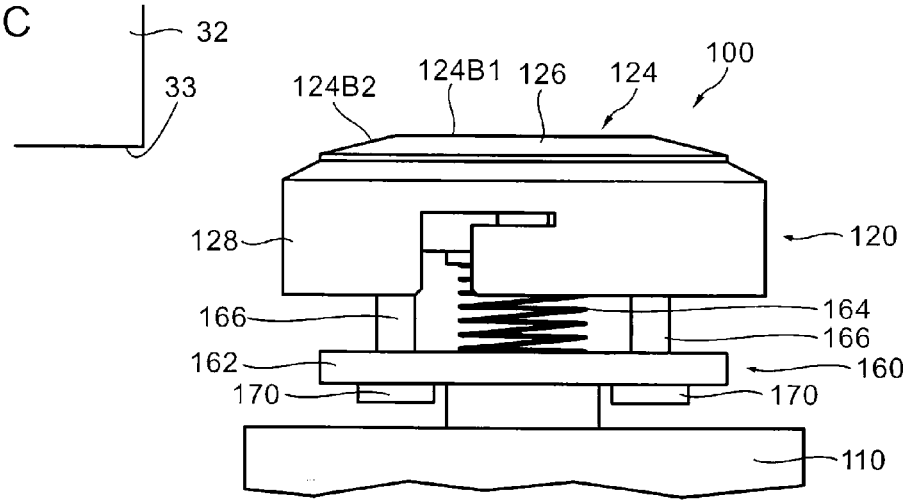

When the rear end of the head 32 has passed the wiping pad 120 completely, as shown in FIG. 15C, the wiping pad 120 returns to its original position, in other words, a position where the upper surface thereof is higher than the lower surface of the head 32. Thereupon, the rotation is halted.

Subsequently, the controller drives the elevator apparatus, lowers the wiping unit main case 180 and moves the wiping apparatus 100 to a withdrawn position.

By means of the foregoing, cleaning of the nozzle surfaces is completed.

As described above, according to the inkjet recording apparatus 10 of the present embodiment, a nozzle surface 33 is wiped by a rotating wiping pad 120. Consequently, the nozzle surface 33 can be wiped from multiple directions and it is possible effectively to prevent the lyophobic film from deteriorating, or adhering material from being pushed inside the nozzles, due to wiping in one direction only.

Furthermore, by providing a suspension mechanism 160, it is possible to abut the wiping pad 120 smoothly against the nozzle surface 33 (in other words, to abut the wiping pad 120 without causing dents, or the like). Moreover, the wiping pad 120 can be abutted in a stable fashion without applying undue force.

Furthermore, the wiping apparatus 100 has a composition which rotates the wiping pad 120 only, and therefore a compact composition can be adopted.

The wiping cloth 126 becomes soiled during use and therefore is replaced as appropriate (normally, the wiping cloth is replaced after one use).

The work of replacing the wiping cloth 126 is carried out by removing the wiping pad 120 from the wiping apparatus 100. As described above, the rotating shaft 162A of the rotating base 162 which constitutes the suspension mechanism 160 is provided detachably with respect to the coupling 152, and therefore each wiping cloth 126 is replaced by removing the respective wiping pad 120 on each suspension mechanism 160 from this portion of the rotating shaft 162A. By this means, the task of replacing the wiping member can be carried out easily.

Furthermore, the wiping cloth 126 can be replaced simply by removing the pad cover 128, taking off the old wiping cloth 126 and then placing the new wiping cloth 126 on the pad main body 124 and then simply re-installing the pad cover 128.

Second Embodiment

Figure 16:
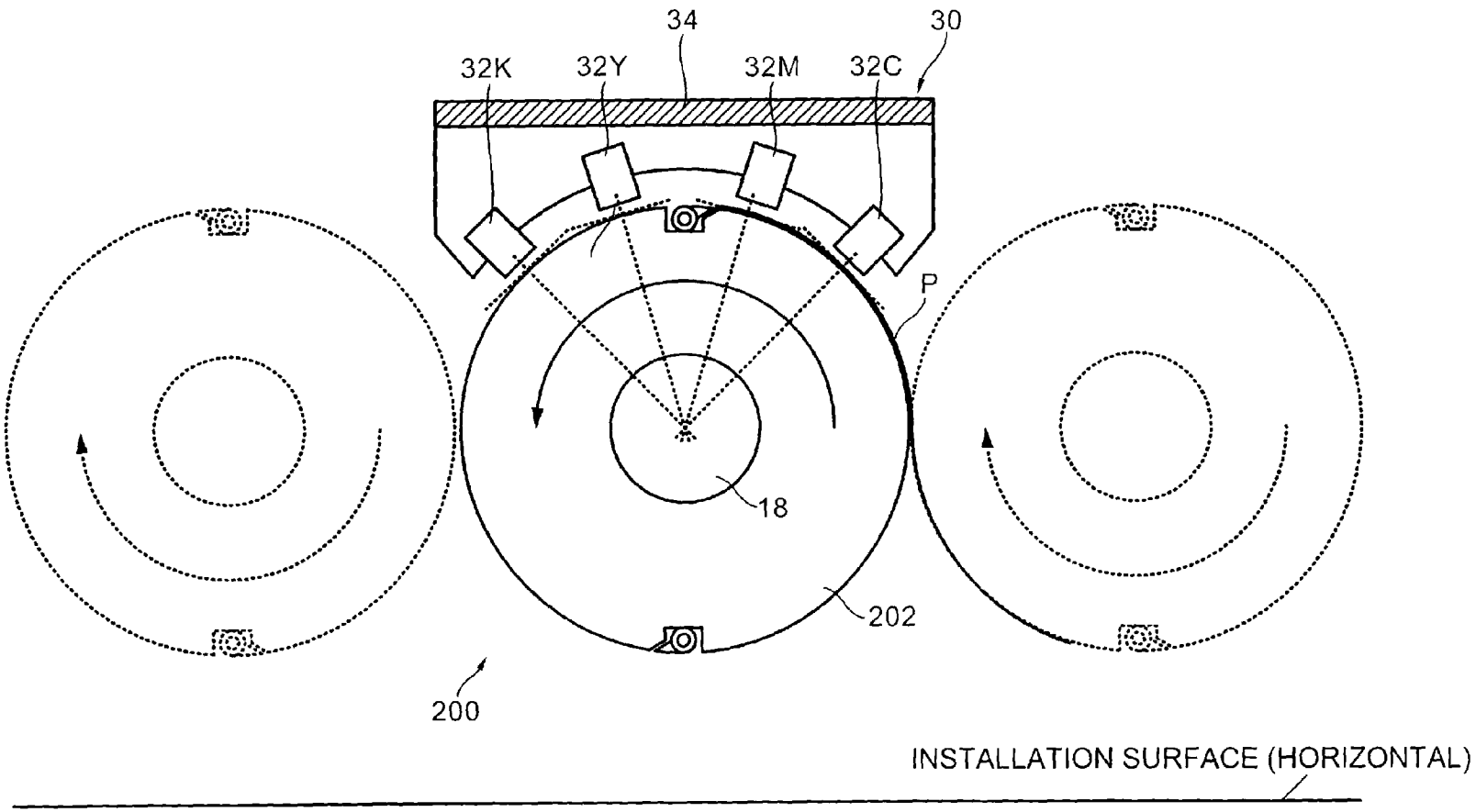
FIG. 16 is a side surface diagram showing the composition of the principal part of an inkjet recording apparatus (second embodiment)

FIG. 16 is a side view diagram showing a composition of the principal part of an inkjet recording apparatus according to a second embodiment of the invention.

As shown in FIG. 16, in the inkjet recording apparatus according to the present embodiment, the paper conveyance mechanism 200 is constituted by a drum conveyance mechanism. In a drum conveyance mechanism, the paper P is suctioned onto a circumferential surface of a drum 202, and the paper P is conveyed by causing the drum 202 to rotate.

In this case, the heads 32C, 32M, 32Y, 32K are arranged in radiating fashion about the periphery of the drum 202. As a result of this, the heads 32C, 32M, 32Y, 32K are arranged with the nozzle surfaces 33C, 33M, 33Y, 33K in an inclined fashion.

Figure 17:
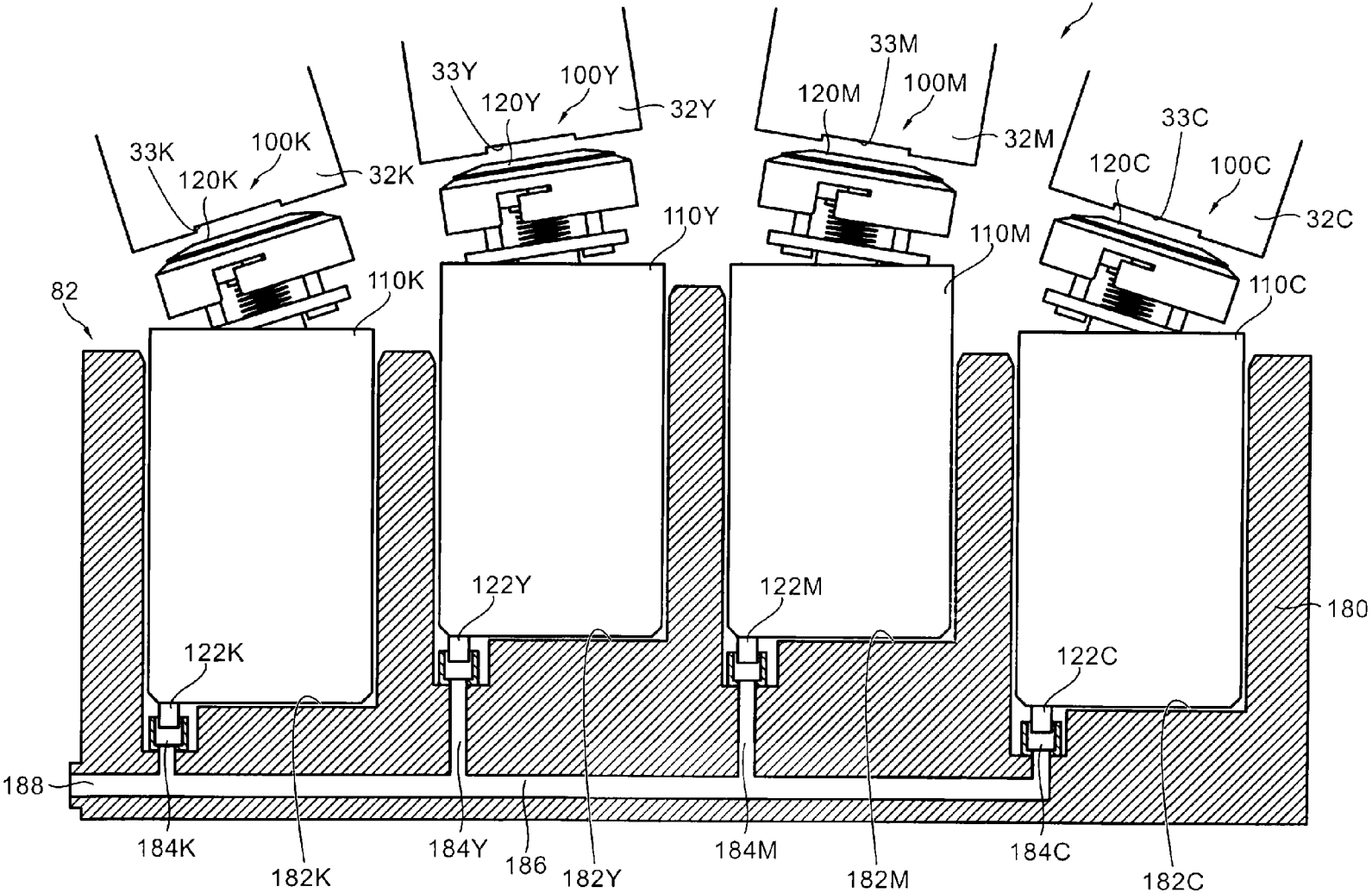
FIG. 17 is a partial cross-sectional side face diagram showing the general composition of a wiping unit.

As a result of the nozzle surfaces 33C, 33M, 33Y, 33K of the heads 32C, 32M, 32Y, 32K being arranged in an inclined fashion, as shown in FIG. 17, the wiping unit 80 is arranged with the wiping pads 120C, 120M, 120Y, 120K of the wiping apparatuses 100C, 100M, 100Y, 100K disposed in an inclined fashion.

Figure 18:
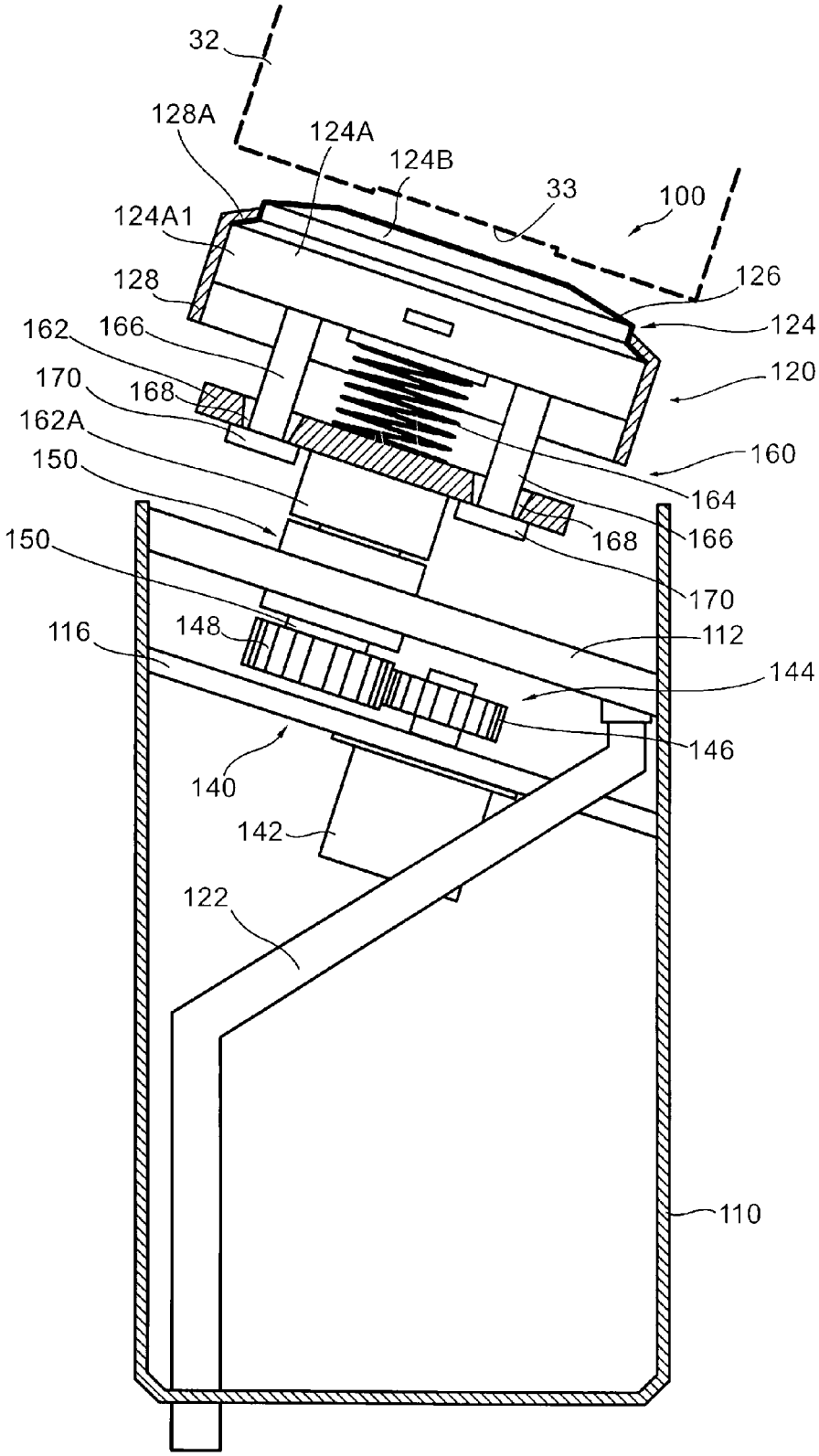
FIG. 18 is a cross-sectional side view diagram showing the composition of a wiping apparatus.

FIG. 18 is a side view cross-sectional diagram showing the composition of a wiping apparatus.

As shown in FIG. 18, the wiping apparatus 100 is arranged with the wiping pad 120 in an inclined fashion so as to correspond to the nozzle surface 33 of the head 32 which is arranged in an inclined fashion. In other words, the wiping apparatus 100 is set in such a manner that the nozzle surface 33 of the head 32 and the upper surface of the wiping pad 120 (the circular section 124B1) are parallel.

In this way, when the nozzle surface 33 of the head 32 is arranged in an inclined fashion, the wiping pad 120 is also arranged in an inclined fashion so as to match the nozzle surface 33. Consequently, it is possible to rotate and abut the wiping pad 120 against the inclined nozzle surface 33.

In this case, since the wiping apparatus main case 110 is arranged vertically, then it is possible to arrange the wiping apparatuses 100C, 100M, 100Y, 100K without giving rise to mutual interference, even in a narrow space.

<<Further Embodiments of the Cleaning Liquid Deposition Units>>

In the embodiment described above, a composition is adopted in which a nozzle surface 33 is moistened by blowing cleaning liquid towards the nozzle surface 33, but the method of moistening the nozzle surface 33 is not limited to this.

Figure 19:
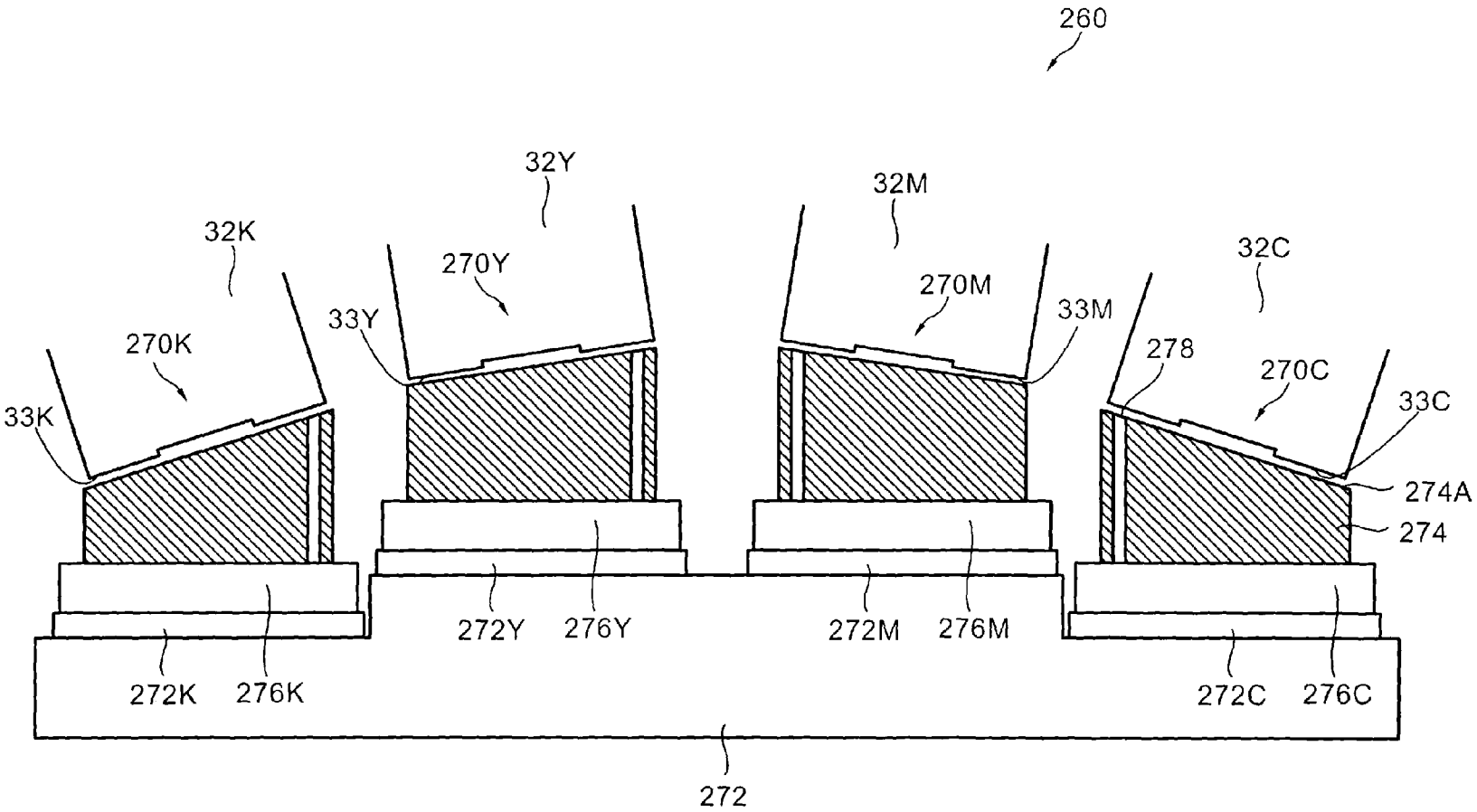
FIG. 19 is a side view diagram of a further embodiment of a cleaning liquid deposition unit.

FIG. 19 is a side view diagram of a further embodiment of a cleaning liquid deposition unit.

This cleaning liquid deposition unit 60 deposits cleaning liquid onto nozzle surfaces 33 (moistens the nozzle surfaces 33) by holding cleaning liquid in the form of a film on the nozzle surfaces 33.

The example shown in FIG. 19 is one where cleaning liquid is deposited onto the nozzle surfaces 33 of heads 32 which are arranged in an inclined fashion (a cleaning liquid deposition unit which is employed in an inkjet recording apparatus according to the second embodiment).

As shown in FIG. 19, the cleaning liquid deposition unit 260 is principally constituted by cleaning liquid deposition apparatuses 270C, 270M, 270Y, 270K which are provided to correspond to the heads 32C, 32M, 32Y, 32K, and a base 272 on which the cleaning liquid deposition apparatuses 270C, 270M, 270Y, 270K are installed.

The base 272 is arranged horizontally and is provided so as to be raisable and lowerable by an elevator apparatus, which is not illustrated. Cleaning liquid deposition apparatus installation sections 272C, 272M, 272Y, 272K are formed on the upper surface portion of the base 272. The cleaning liquid deposition apparatuses 270C, 270M, 270Y, 270K are installed in fixed fashion, by bolts or the like, on the cleaning liquid deposition apparatus installation sections 272C, 272M, 272Y, 272K formed on the base 272.

The cleaning liquid deposition apparatuses 270C, 270M, 270Y, 270K are arranged along the movement path of the corresponding heads 32C, 32M, 32Y, 32K by being installed on this base 272.

Figure 20:
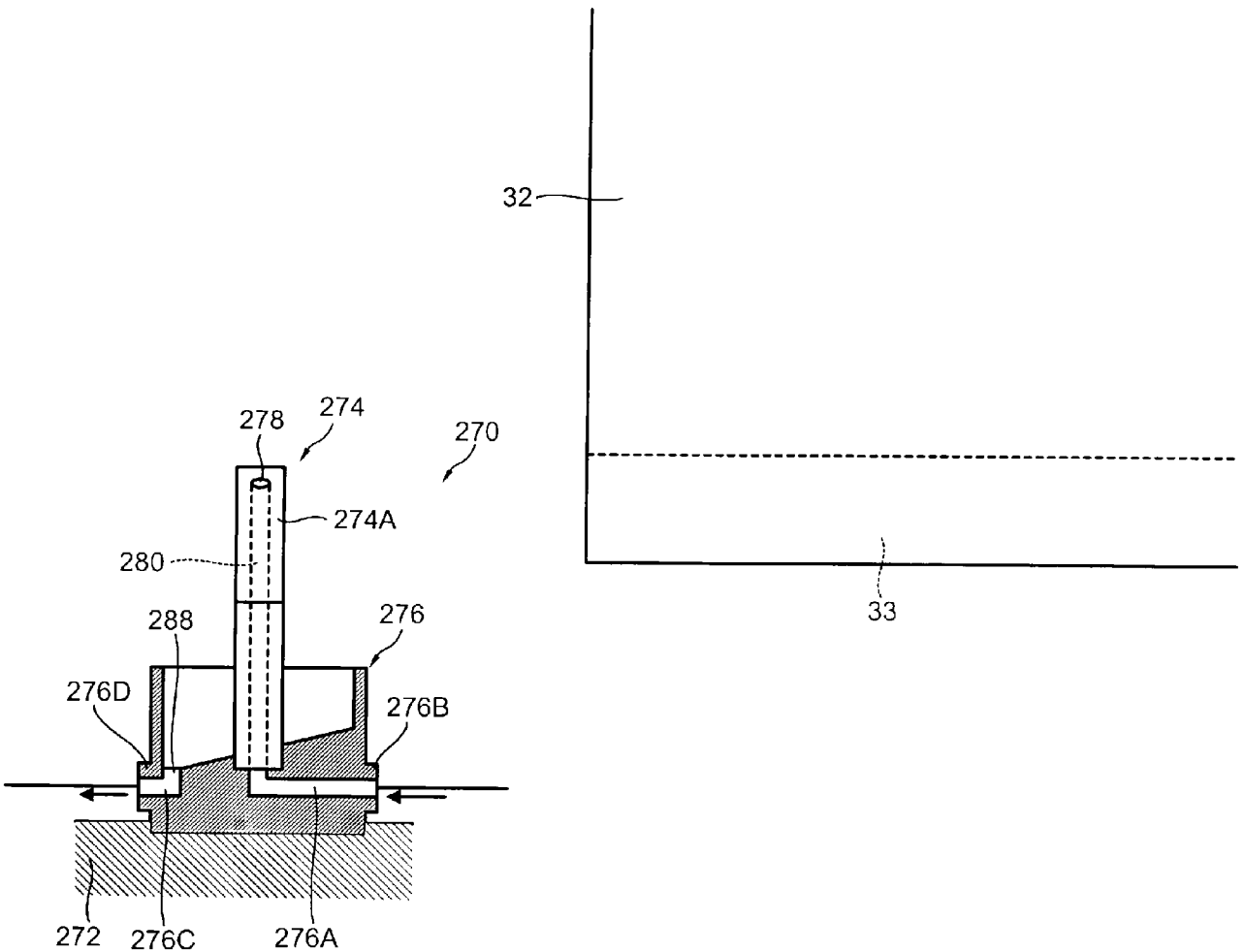
FIG. 20 is cross-sectional front surface diagram of a cleaning liquid deposition apparatus.

FIG. 20 is a front view cross-sectional diagram of a cleaning liquid deposition apparatus.

The cleaning liquid deposition apparatuses 270C, 270M, 270Y, 270K all have the same composition and therefore the composition is described here with respect to one cleaning liquid deposition apparatus 270.

The cleaning liquid deposition unit 270 includes a cleaning liquid deposition head 274 which deposits cleaning liquid onto the nozzle surface 33 and a cleaning liquid recovery tray 276 which recovers cleaning liquid that has fallen down from the nozzle surface 33.

The cleaning liquid recovery tray 276 is formed in the shape of a square box of which the upper portion is open. The cleaning liquid deposition head 274 is erected perpendicularly inside the cleaning liquid recovery tray 276.

The cleaning liquid deposition head 274 is formed in a quadrilateral block shape with an inclined upper surface, and has an inclined cleaning liquid holding surface 274A, on the upper portion thereof. The cleaning liquid holding surface 274A is formed at the same angle of inclination as the nozzle surface 33 of the head that is to be cleaned, and is formed to a slightly greater width than the width of the nozzle surface 33 (the width in the paper conveyance direction).

A cleaning liquid emission port 278 is formed in the vicinity of the upper part of the cleaning liquid holding surface 274A, and cleaning liquid flows out from this cleaning liquid emission port 278. The cleaning liquid which has flowed out from the cleaning liquid emission port 278 flows down over the cleaning liquid holding surface 274A. By this means, a layer (film) of cleaning liquid is formed on the cleaning liquid holding surface 274A. Cleaning liquid is applied to the nozzle surface 33 of the head 32 by bringing the nozzle surface 33 into contact with the layer of cleaning liquid formed on the cleaning liquid holding surface 274A.

A supply flow channel 280 connected to the cleaning liquid emission port 278 is formed inside the cleaning liquid deposition head 274. This supply flow channel 280 is connected to a connection flow channel 276A formed in the cleaning liquid recovery tray 276 and the connection flow channel 276A is connected to a cleaning liquid supply port 276B formed in the cleaning liquid recovery tray 276. When cleaning liquid is supplied to the cleaning liquid supply port 276B in the cleaning liquid deposition head 274, cleaning liquid flows out from the cleaning liquid emission port 278.

The cleaning liquid is supplied from a cleaning liquid tank (not illustrated). A pipe (not illustrated) connected to this cleaning liquid tank is connected to the cleaning liquid supply port 276B. A cleaning liquid supply pump (not illustrated) and valve (not illustrated) are provided in this pipe, and by opening the valve and driving the cleaning liquid supply pump, cleaning liquid is supplied from the cleaning liquid tank to the cleaning liquid deposition head 274.

The cleaning liquid recovery tray 276 is formed in the shape of a square box, the upper portion of which is open, as described above. The bottom portion of the cleaning liquid recovery tray 276 is formed in an inclined fashion and a recovery hole 288 is formed in the lower end portion in the direction of inclination. This recovery hole 288 is connected to a cleaning liquid discharge outlet 276D formed in a side face portion of the cleaning liquid recovery tray 276, via a recovery flow channel 276C formed inside the cleaning liquid recovery tray 276.

The cleaning liquid emitted from the cleaning liquid emission port 278 of the cleaning liquid deposition head 274 falls down from the cleaning liquid holding surface 274A and is recovered into the cleaning liquid recovery tray 276. The cleaning liquid recovered in the cleaning liquid recovery tray 276 is recovered in the waste liquid tank 58 by passing along a waste liquid pipe (not illustrated) which is connected to the cleaning liquid discharge outlet 276D.

The cleaning liquid deposition unit 260 has the composition described above. Cleaning liquid is deposited by the cleaning liquid deposition unit 60 in the following manner.

As described above, the base 272 is provided so as to be raisable and lowerable. When not performing cleaning, the base 272 is situated in a prescribed standby position. During cleaning, the base 272 is raised by a prescribed amount from the standby position and is moved to a prescribed operating position.

When the base 272 is moved to the operating position, the cleaning liquid deposition apparatuses 270 are set in prescribed cleaning liquid deposition positions. Consequently, it is possible to deposit cleaning liquid onto the nozzle surfaces 33 of the heads 32 by the cleaning liquid deposition heads 274 provided in the cleaning liquid deposition unit 260. More specifically, when the cleaning liquid deposition apparatuses 270 are set in the cleaning liquid deposition position, they are set in a position in which the cleaning liquid which flows over the cleaning liquid holding surfaces 274A of the cleaning liquid deposition heads 274 makes contact with the nozzle surfaces 33 (where the gap between the cleaning liquid holding surfaces 274A and the nozzle surfaces 33 is in a prescribed range).

When the cleaning liquid deposition apparatuses 270 are set in the prescribed cleaning liquid deposition position, then the controller causes the head supporting frame 34 to move from the maintenance position towards the image recording position.

The controller drives the suction pump in accordance with the timing at which the heads 32 arrive at the cleaning liquid deposition head 274. By this means, cleaning liquid flows out at a prescribed flow rate from the cleaning liquid emission ports 278 of the cleaning liquid deposition heads 274. The cleaning liquid which has flowed out from the cleaning liquid emission ports 278 flows down over the cleaning liquid holding surfaces 274A. Consequently, a layer (film) of cleaning liquid is formed on the cleaning liquid holding surfaces 274A.

As the heads 32 travelling towards the image recording position pass the cleaning liquid deposition head 274, the nozzle surfaces 33 thereof each make contact with the layer of cleaning liquid formed on the cleaning liquid holding surface 274A of the corresponding cleaning liquid deposition head 274. Therefore, the cleaning liquid is deposited onto the nozzle surfaces 33.

In this way, it is also possible to moisten each nozzle surface 33 by bringing the nozzle surface 33 into contact with a layer (film) of cleaning liquid formed on a surface parallel to the nozzle surface 33.

Apart from this, it is also possible to moisten the nozzle surfaces 33 by causing ink to seep out from the nozzles formed on the nozzle surfaces 33.

Other Embodiments

In the embodiments described above, a composition is adopted in which a nozzle surface is wiped with a wiping cloth, but the member which wipes the nozzle surface is not limited to this. Apart from this, it is also possible to adopt a composition which wipes the nozzle surface with a sponge, or the like, for instance.

Furthermore, in the embodiments described above, a composition is adopted in which a wiping cloth is fixed by being sandwiched between a pad main body and a pad cover, but the composition for fixing the wiping cloth is not limited to this. It is also possible to adopt a composition which fixes the wiping cloth by using a detachable adhesive, for instance. Moreover, the pad cover may be fixed to the pad main body by a screw, or the like.

Moreover, in the embodiment described above, a composition is adopted in which a wiping pad is removed with the respective suspension member, but it is also possible to remove the wiping pad only.

Furthermore, in the embodiment described above, a wiping pad is supported in raisable/lowerable fashion, and oscillatable fashion, by four sliding rods, but the number of sliding rods installed is not limited to this. It is sufficient to provide at least two sliding rods.

Moreover, in the present embodiment, an example of cleaning the nozzle surfaces of line heads is described, but the present invention can also be applied similarly to a case of cleaning the nozzle surfaces of shuttle heads.

Furthermore, in the embodiment described above, a composition is adopted in which the heads are moved to wipe the nozzle surfaces, but it is also possible to adopt a composition in which the nozzle surfaces are wiped by moving the wiping units (wiping apparatuses). Similarly, it is also possible to wipe the nozzle surfaces by moving both the heads and the wiping units (wiping apparatuses).

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An inkjet recording apparatus, comprising:

a conveyance device which conveys a recording medium;

an inkjet head which has a nozzle surface, in which nozzles are arranged, and which ejects ink droplets from the nozzles towards the recording medium which is conveyed by the conveyance device; and a wiping apparatus which wipes the nozzle surface by moving relatively along the nozzle surface of the inkjet head, wherein the wiping apparatus comprises:

a wiping member formed into a circular shape and which is abutted against the nozzle surface; and a rotational drive device which causes the wiping member to rotate about an axis perpendicular to the nozzle surface, wherein the wiping member comprises:

a pad formed into a circular disk shape;

a replaceable wiping cloth which covers an upper surface of the pad, the pad having a flat circular section, and the nozzle surface is wiped by abutting the flat circular section against the nozzle surface.

2. The inkjet recording apparatus as defined in claim 1, further comprising:

a supporting device which supports the wiping member movably in a direction perpendicular to the nozzle surface; and an biasing device which biases the wiping member towards the nozzle surface.

3. The inkjet recording apparatus as defined in claim 2, wherein the supporting device supports the wiping member movably in a direction perpendicular to the nozzle surface, as well as supporting the wiping member in oscillatable fashion.

4. The inkjet recording apparatus as defined in claim 1, further comprising:

a rod which is coupled to the wiping member;

a rotating base which is driven so as to rotate by the rotational drive device;

a guide hole for guiding the rod, the guide hole being formed in the rotating base, and through which the rod is inserted; and a spring, one end of which is coupled to the wiping member and the other end of which is coupled to the rotating base.

5. The inkjet recording apparatus as defined in claim 4, wherein the guide hole is formed in a tapered shape so as to broaden towards the wiping member side.

6. The inkjet recording apparatus as defined in claim 4, wherein a plurality of rods each of which serves as the rod and a plurality of guide holes each of which serves as the guide hole are arranged concentrically with the center of rotation of the wiping member.

7. The inkjet recording apparatus as defined in claim 1, wherein the wiping member is formed in a tapered shape so that a circumferential edge portion diverges.

8. The inkjet recording apparatus as defined in claim 7, wherein a recess section is formed in a center of the wiping member.

9. The inkjet recording apparatus as defined in claim 1, wherein the pad is provided detachably.

10. The inkjet recording apparatus as defined in claim 9, wherein the pad comprises:

a pad main body; and a ring-shaped cover member, which is provided detachably on the pad main body and which covers a circumferential edge portion of the pad main body, the wiping cloth being installed on the pad main body by sandwiching a circumferential edge portion of the wiping cloth between the pad main body and the cover member.

11. The inkjet recording apparatus as defined in claim 1, wherein at least a portion of the pad which is covered by the wiping cloth is made from an elastic body.

12. The inkjet recording apparatus as defined in claim 1, further comprising a cleaning liquid deposition device which deposits cleaning liquid onto the nozzle surface by moving relatively along the nozzle surface of the inkjet head.

13. The inkjet recording apparatus as defined in claim 12, wherein the wiping apparatus has a tray which is provided below the wiping member, and which recovers the cleaning liquid that has dripped down from the wiping member.

14. The inkjet recording apparatus as defined in claim 1, wherein the conveyance device conveys the recording medium by wrapping the recording medium about a circumferential surface of a rotating drum; and the inkjet head is arranged in an inclined fashion with respect to the horizontal plane, in such a manner that the nozzle surface opposes the circumferential surface of the drum.

* * * * *